US012312916B1

(12) United States Patent
von Gynz-Rekowski et al.

(10) Patent No.: US 12,312,916 B1
(45) Date of Patent: May 27, 2025

(54) DOWNHOLE APPARATUS WITH CAVITY FOR HOUSING CHEMICALS

(71) Applicant: Workover Solutions, Inc., Imperial, PA (US)

(72) Inventors: Gunther H H von Gynz-Rekowski, Montgomery, TX (US); Carl Andrew Rosenholm, Sugar Land, TX (US); Brandon Kaderka, Katy, TX (US); Kevin J. Rudy, Tomball, TX (US)

(73) Assignee: Workover Solutions, Inc., Imperial, PA (US)

( * ) Notice: Subject to any disclaimer, the term of this patent is extended or adjusted under 35 U.S.C. 154(b) by 0 days.

(21) Appl. No.: 18/540,786

(22) Filed: Dec. 14, 2023

(51) Int. Cl.

| | |
|---|---|
| ***E21B 37/06*** | (2006.01) |
| ***E21B 31/00*** | (2006.01) |
| ***E21B 33/12*** | (2006.01) |
| ***E21B 47/07*** | (2012.01) |

(52) U.S. Cl.
CPC ..... *E21B 37/06* (2013.01); *E21B 31/00* (2013.01); *E21B 33/12* (2013.01); *E21B 47/07* (2020.05); *E21B 2200/08* (2020.05)

(58) Field of Classification Search
CPC ..... E21B 37/06; E21B 31/00; E21B 33/12; E21B 47/07; E21B 2200/08; E21B 29/02
See application file for complete search history.

(56) References Cited

U.S. PATENT DOCUMENTS

| | | | | |
|---|---|---|---|---|
| 2,641,185 | A * | 6/1953 | Lockett | E21B 43/11855 102/257 |
| 10,422,199 | B1 * | 9/2019 | Subbaraman | E21B 33/1208 |
| 2005/0205264 | A1 | 9/2005 | Starr et al. | |
| 2010/0132960 | A1 | 6/2010 | Shkurti et al. | |
| 2012/0285695 | A1 * | 11/2012 | Lafferty | C09K 8/03 166/310 |
| 2013/0299192 | A1 | 11/2013 | Xu et al. | |
| 2018/0252067 | A1 | 9/2018 | Fripp et al. | |
| 2019/0128081 | A1 * | 5/2019 | Ross | E21B 34/066 |
| 2019/0264520 | A1 | 8/2019 | Frazier | |
| 2021/0254421 | A1 * | 8/2021 | Tonti | E21B 23/01 |
| 2022/0018208 | A1 | 1/2022 | Cracker et al. | |

OTHER PUBLICATIONS

Co-pending U.S. Appl. No. 17/374,230, filed Jul. 13, 2021, titled "Self Cleaning Fracking Plug and Method".
International Search Report and Written Opinion, mailed Nov. 14, 2024, for corresponding International Patent Application No. PCT/US2024/053254.

* cited by examiner

*Primary Examiner* — Yanick A Akaragwe
(74) *Attorney, Agent, or Firm* — Jones Walker LLP

(57) ABSTRACT

A downhole apparatus with an internal surface defining a cavity. The cavity houses one or more sealed packs containing chemicals used in wellbore operations. The downhole apparatus optionally includes either fluid ports to equalize the wellbore pressure or one or more compensating pistons for adjusting the volume of the cavity in response to wellbore conditions such as temperature or hydrostatic pressure. The chemicals are released into the wellbore when the downhole apparatus is milled or when the sealed packs are dissolved.

16 Claims, 30 Drawing Sheets

DOWNHOLE APPARATUS WITH CAVITY FOR HOUSING CHEMICALS

BACKGROUND OF THE DISCLOSURE

During oil and gas operations chemicals are often injected into the wellbore from the surface and pumped downhole to aid the operations. For example, cleaning chemicals are injected into the wellbore to assist in the removal of milled pieces of downhole tools from the wellbore. Corrosion inhibitors are injected into the wellbore to prevent downhole tool corrosion. To circumvent the injection of chemicals, sealed containers have been developed to house chemicals. The sealed containers run downhole on a tubular with other downhole tools. The sealed containers, however, suffer from leakage or rupture due to high hydrostatic pressure resulting in uncontrolled and untimely placement of the chemicals into the wellbore. Consequently, rigid structures are employed to help prevent the leakage or rupture of the container due to high hydrostatic pressure, but this is also problematic because the rigid structures require the use of sophisticated and complex techniques and mechanisms to selectively release the chemicals from the sealed containers. Accordingly, there is a need for an improved downhole apparatus for housing chemicals used in downhole operations such as drilling, completion, or other wellbore procedures that achieves effective transport of the chemicals, eliminates undesired and untimely leakage or rupture, and selectively releases the chemicals through a simple, expedited, and straightforward process.

SUMMARY OF THE DISCLOSURE

An embodiment of a downhole apparatus for a wellbore operation is disclosed. The downhole apparatus has an internal surface defining a cavity, one or more sealed packs disposed within the cavity, and one or more chemicals disposed within each of the one or more sealed packs. The downhole apparatus is operatively connected to a drilling assembly, a fishing assembly, a well-intervention assembly, or a well-plugging assembly. The one or more chemicals are in the form of a solid, a liquid, a powder, or a gel. The one or more chemicals are friction reducers, lubricators, corrosion inhibitors, dyes, pH additives, dry acids, salts, biocides, bio inhibitors, dry hydrogen peroxides, chelation agents, emulsifiers, thinners, wellbore additives, or any combination thereof.

In another embodiment of the downhole apparatus, the downhole apparatus includes an outer surface and an internal surface with the internal surface defining a cavity, one or more sealed packs disposed within the cavity, and one or more chemicals disposed within each of the one or more sealed packs.

In yet another embodiment of the downhole apparatus, the cavity is a communicating cavity. The downhole apparatus includes one or more ports extending from the outer surface to the internal surface, wherein the ports provide fluid communication between the wellbore and the communicating cavity. Alternatively, the downhole apparatus includes one or more compensating pistons positioned within the communicating cavity, the one or more compensating pistons configured to adjust a volume of the communicating cavity in selective response to a condition within the wellbore. The condition is a wellbore temperature or a wellbore hydrostatic pressure.

In these embodiments, the one or more chemicals are in the form of a solid, a liquid, a powder, or a gel. The one or more chemicals are well-cleaning agents, suspending agents, or wellbore additives. The one or more sealed packs may be at least one sealed pack having one or more flexible sides. The one or more sealed packs may be at least one vacuum sealed pack.

In these embodiments, the downhole apparatus is operatively connected to a well-plugging assembly. The well-plugging assembly is a bridge plug, a frac plug, or a packer assembly. The downhole apparatus is operatively connected to a mandrel or housing of the well-plugging assembly. The downhole apparatus is directly connected to a shoe nut and wherein the shoe nut is directly connected to the mandrel or housing of the well-plugging assembly.

A method of performing a wellbore operation is also disclosed. The method includes the steps of running a downhole apparatus down the wellbore, the downhole apparatus having an internal surface defining a cavity, one or more sealed packs disposed within the cavity, and one or more chemicals disposed within each of the one or more sealed packs. The method includes the step of releasing the one or more chemical substances disposed within the one or more sealed packs by milling or dissolving the one or more sealed packs. In the method, the downhole apparatus is operatively connected to a drilling assembly, a fishing assembly, a well-intervention assembly, or a well-plugging assembly. In the method, the one or more chemicals are in the form of a solid, a liquid, a powder, or a gel. In the method, the one or more chemicals are well-cleaning agents, suspending agents, friction reducers, lubricators, corrosion inhibitors, dyes, pH additives, dry acids, salts, biocides, bio inhibitors, dry hydrogen peroxides, chelation agents, emulsifiers, thinners, wellbore additives, or any combination thereof.

In the method, another embodiment of the downhole apparatus is used that includes an outer surface and a communicating cavity. In this embodiment, the downhole apparatus includes one or more ports extending from the outer surface to the internal surface, wherein the ports provide fluid communication between the wellbore and the communicating cavity. Alternatively, the downhole apparatus includes one or more compensating pistons positioned within the communicating cavity, the compensating pistons configured to adjust a volume of the communicating cavity in selective response to a condition within the wellbore. In the method, the condition is a wellbore temperature or a wellbore hydrostatic pressure.

DETAILED DESCRIPTION OF THE PREFERRED EMBODIMENTS

Figure 1:
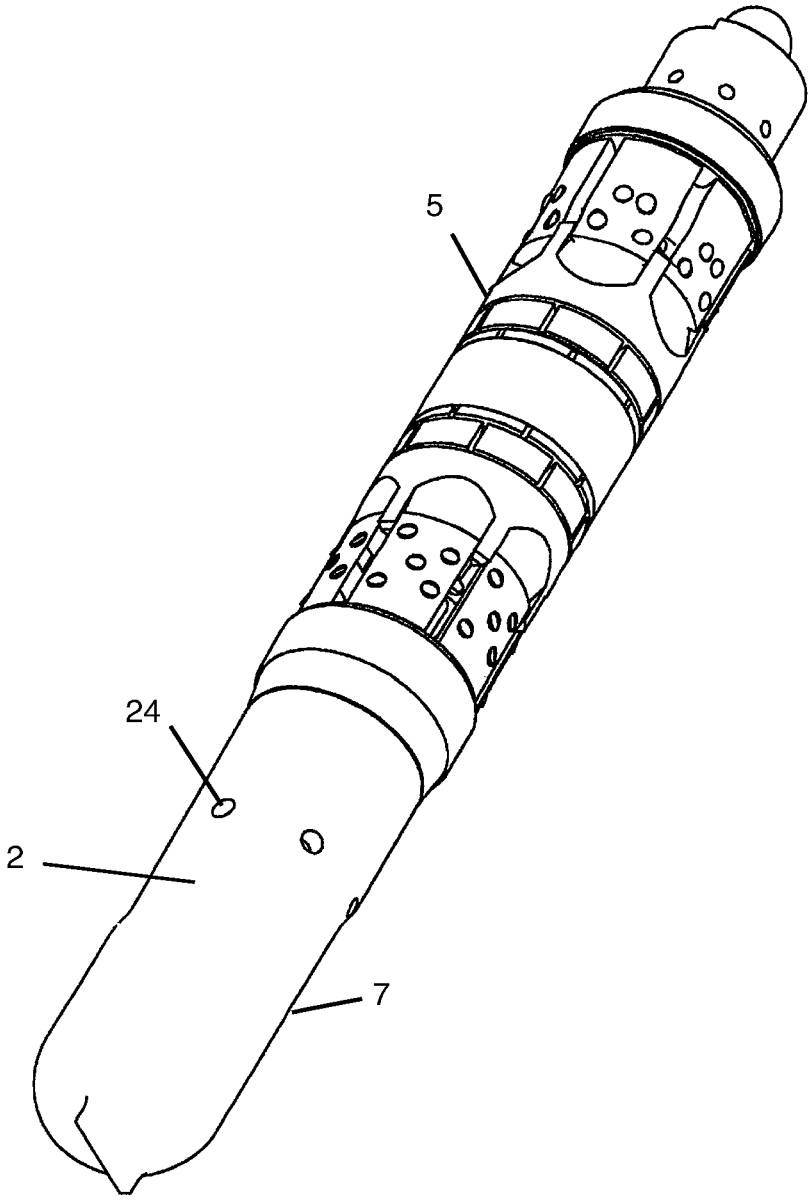
FIG. 1 is a perspective view of an embodiment of a downhole apparatus of the present disclosure operatively connected to a well-plugging assembly.

A downhole apparatus is disclosed having an internal surface defining a cavity for housing chemicals for use during wellbore operations. The chemicals are contained within one or more sealed packs that are placed within the cavity of the downhole apparatus. Milling of the downhole apparatus causes a release of the chemicals from the sealed packs. Alternatively, the sealed packs are subjected to environmental or other agents that cause the sealed packs to dissolve thereby releasing the chemicals. In some embodiments, the cavity of the downhole apparatus is a communicating cavity. As used herein, the term "communicating cavity" is defined as and encompasses a cavity that is in fluid communication with the wellbore, as for example, via ports extending through the downhole apparatus. Consequently, the pressure in the communicating cavity of the downhole apparatus is the same as or equalized to the pressure in the adjacent wellbore. The term "communicating cavity" is also defined as and encompasses a cavity where the downhole apparatus is configured to adjust the cavity's volume in response to wellbore conditions. For example, the volume of the cavity may be adjusted by actuation of one or more compensating pistons within the downhole apparatus. Communication with the communicating cavity of the downhole apparatus is preferable due to concerns of gas expansion or gas reduction when the communicating cavity is exposed to downhole conditions such as high temperature or high hydrostatic pressure.

Various embodiments of the downhole apparatus are shown in the accompanying drawings and described herein. The downhole apparatus is operatively connected to different downhole tools or assemblies depending on specific wellbore operations. For example, the downhole apparatus is operatively connected to a drilling assembly, a fishing assembly, a well-intervention assembly, or a well-plugging assembly. When operatively connected to a drilling assembly, the downhole apparatus provides chemicals useful during drilling operations. When operatively connected to a fishing assembly, the downhole apparatus provides chemicals useful during retrieval operations for lost pipe or other wellbore components. When operatively connected to a well-intervention assembly, the downhole apparatus provides chemicals useful during well work operations while the well is productive. When operatively connected to well-plugging assembly, the downhole apparatus provides chemicals useful during well completion including milling of the plugs. Well plugging assemblies are also used for well abandonment procedures. Drilling assemblies include drill bits, mud motors, percussion tools, and other associated drilling tools. Well-plugging assemblies including all types of plugs such as frac plugs, bridge plugs, and packers used for completion procedures. The downhole apparatus is operatively connected to tubulars such as drill string and coiled tubing, or to wireline.

The downhole apparatus houses and transports downhole within the wellbore chemicals useful for aiding or assisting in wellbore operations such as drilling, completion, or wellbore intervention procedures. The chemicals are contained in one or more sealed packs placed within one or more cavities of the downhole apparatus. The chemicals are in the form of a solid, liquid, powder, or gel. Depending on the specific wellbore operation being performed, the chemicals are well cleaning agents, friction reducers, suspending agents, lubricators, corrosion inhibitors, dyes, pH additives, dry acids, salts, biocides, bio inhibitors, dry hydrogen peroxides, chelation agents, emulsifiers, thinners, wellbore additives, or any combination thereof. The chemicals are also an epoxy, resin, thermoplastic, dry-add friction reducer, dry-add gel, dry-add pipe on pipe, or any combination thereof.

Figure 2:
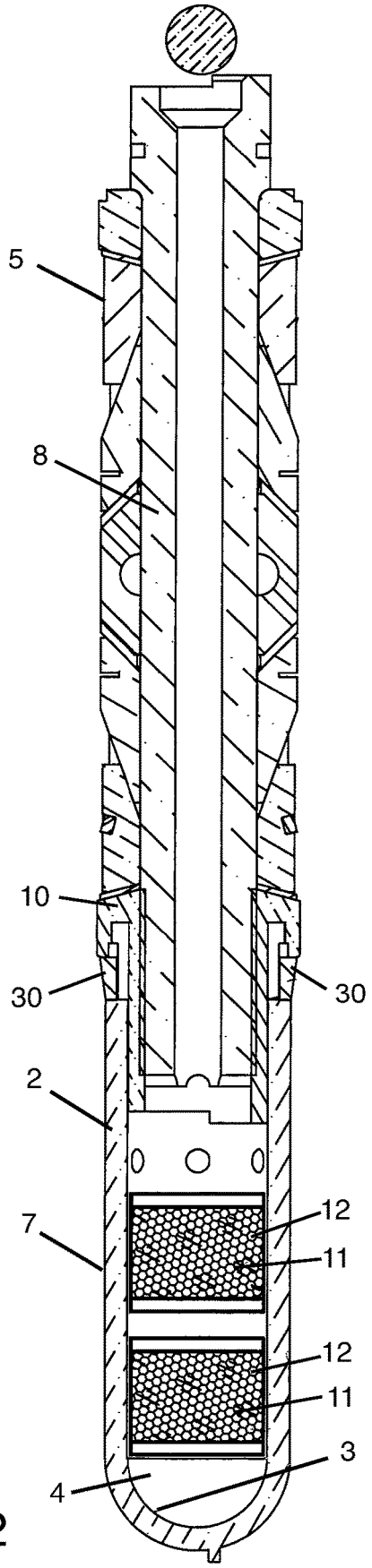
FIG. 2 is a sectional view of the downhole apparatus shown in FIG. 1 containing two sealed chemical packs.
Figure 3:
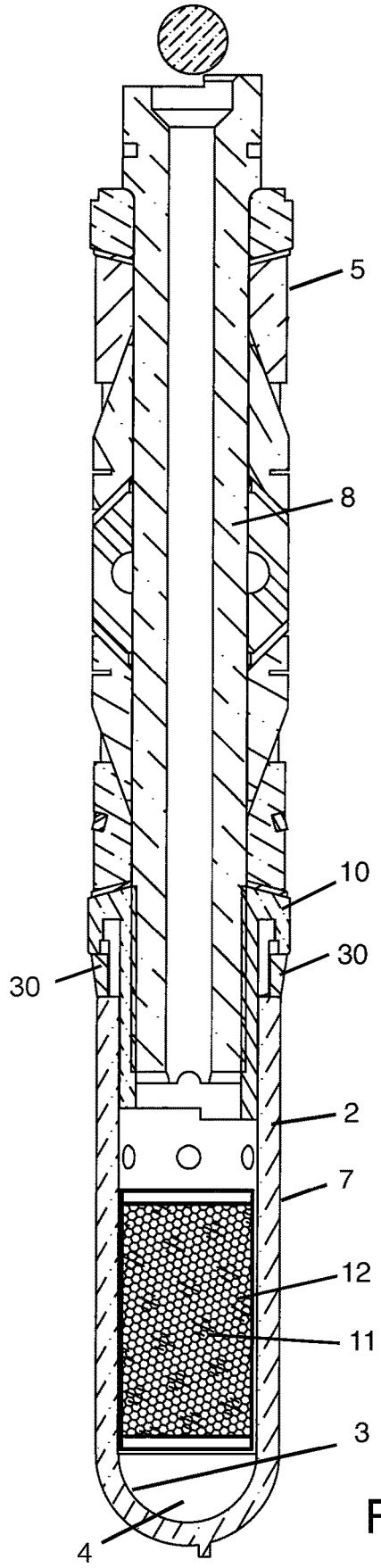
FIG. 3 is a sectional view of the downhole apparatus shown in FIG. 1 containing one sealed chemical pack.

With reference to the figures where like elements have been given like numerical designation to facilitate an understanding of the disclosure, and particularly with reference to the embodiment of the downhole apparatus 2 illustrated in FIGS. 1-3, downhole apparatus 2 is operatively connected to well-plugging assembly 5. Downhole apparatus 2 has outer surface 7 and internal surface 3 defining cavity 4. Downhole apparatus 2 may be any shape or dimension capable of forming cavity 4 and housing a sufficient quantity of chemicals 11. For example, downhole apparatus 2 may be in the cylindrical or in the form of a container. In the form of a container, downhole apparatus 2 includes an open, upper end that provides access to cavity 4 when apparatus 2 is disconnected from the downhole tool (e.g., well-plugging assembly 5) and a lower closed end. Downhole apparatus 2 is operatively connected to the downstream end of the housing of well-plugging assembly 5. In some embodiments, downhole apparatus 2 is operatively connected to the downstream end of mandrel 8 of well-plugging assembly 5. In some embodiments, downhole apparatus 2 is operatively connected to the housing or mandrel 8 of well-plugging assembly 5 via shoe nut 10. Downhole apparatus 2 includes one or more sealed packs 12 containing one or more chemicals 11. As seen in FIG. 3, downhole apparatus 2 includes one sealed pack 12. As revealed in FIG. 2, downhole apparatus 2 includes two sealed packs 12 containing chemicals 11. Downhole apparatus 2 may include any number of sealed packs 12 with chemicals 11, as for example, three or more sealed packs 12 with chemicals 11.

Sealed packs 12 may be made of any material sufficient to provide a barrier between chemicals 11 and fluid in the wellbore 100. Sealed packs 12 are made of dissolvable or non-dissolvable material, such as dissolvable or non-dissolvable plastics. Water-soluble and biodegradable plastics which are based on polyvinyl alcohol (PVOH) are dissolvable. Biodegradable plastics available can be starch-based plastics, bacteria-based plastics, soy-based plastics, cellulose-based plastics and others. Plastics such as polyethylene terephthalate (PET), polyethylene (PE), polypropylene (PP), and polystyrene (PS) are not dissolvable. Sealed packs 12 are formed of a heat-resistant material such that sealed packs 12 can withstand downhole conditions without dissolving, becoming brittle, melting, stretching, or undergoing any other undesirable changes.

If sealed packs 12 are made of a dissolvable material, chemicals 11 disposed therein are released upon dissolution of sealed packs 12 or the milling of sealed packs 12. If sealed packs 12 are made of a non-dissolvable material, chemicals disposed therein are released upon milling of sealed packs 12.

Sealed packs 12 are illustrated in greater detail in FIGS. 4A, 4B, 5A, and 5B. Sealed packs 12 may be any shape. By way of example only, sealed packs 12 have a polygonal cross section in at least one axial direction. Sealed packs 12 may also have an ovular or circular cross section in at least one axial direction. Sealed packs 12 may also have an irregularly shaped cross section in at least one axial direction, which may include cross-sectional shapes having no angles or cross-sectional shapes having angles. Sealed packs 12 may have a variety of dimensions dependent on the volume of chemicals to be contained therein, which volume is determinative of the specific chemical being used and the amount of chemical required to achieve the specific wellbore operation desired.

Figure 4A:
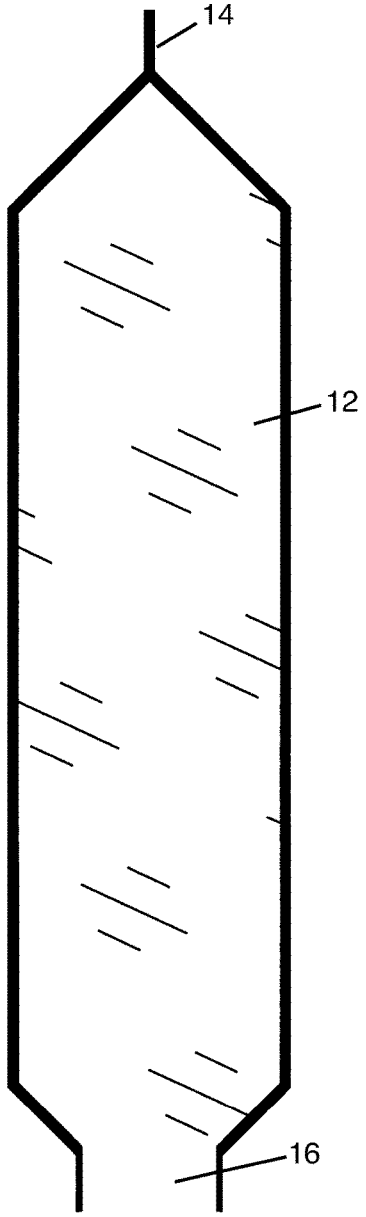
FIG. 4A is a side view of an embodiment of an empty chemical pack with one open end.
Figure 4B:
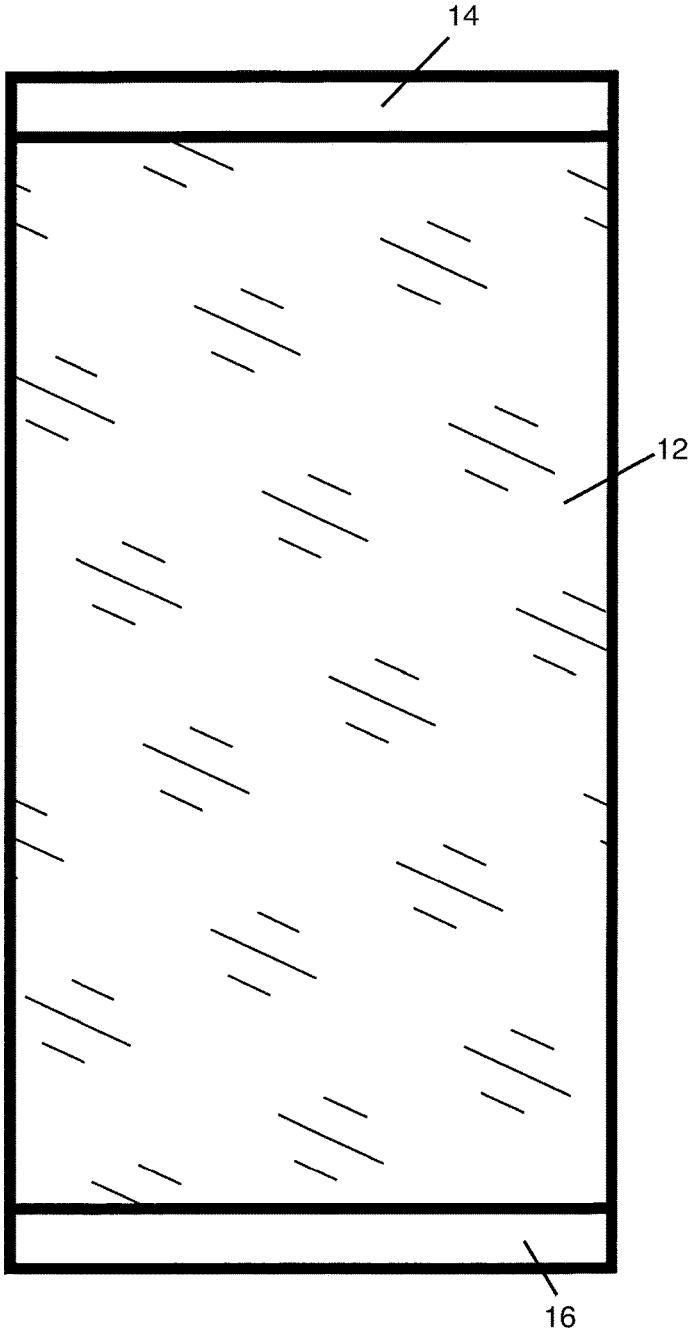
FIG. 4B is a front view of the chemical pack shown in FIG. 4A.
Figure 5A:
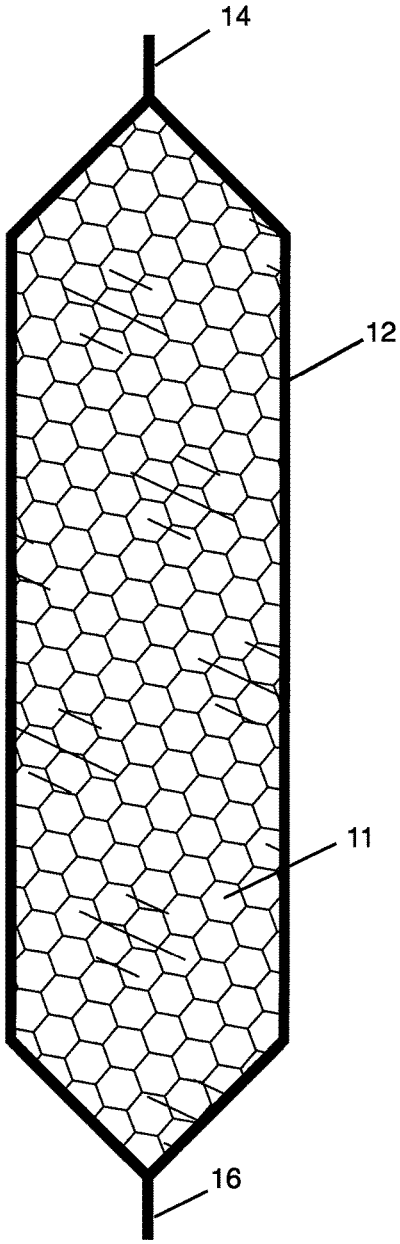
FIG. 5A is a side view of an embodiment of a filled chemical pack with ends sealed.
Figure 5B:
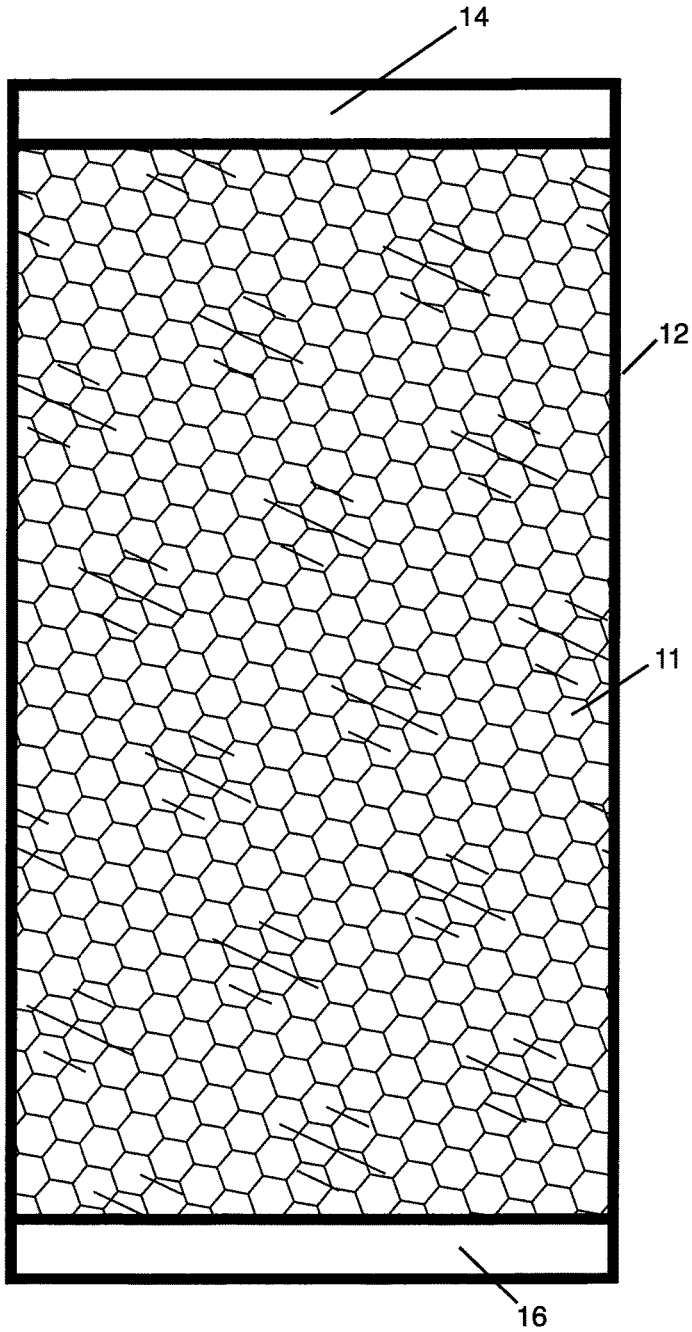
FIG. 5B is a front view of the filled chemical pack shown in FIG. 5A.

FIGS. 4A and 4B show sealed pack 12 empty and without chemicals 11. Accordingly, end 16 is open and not sealed while end 14 is sealed. In FIGS. 5A and 5B, sealed pack 12 is filled with chemicals 11 and has two sealed ends 14, 16. In other embodiments, sealed pack 12 includes three or more sealed ends. One or more of the sealed ends are sealed before or after sealed pack 12 is filled with chemicals 11. Sealed pack 12 is vacuum sealed to minimize gas expansion or reduction when sealed pack 12 is exposed to wellbore conditions such as high temperature or high hydrostatic pressure. Sealed pack 12 has one or more flexible sides to compensate for such expansion in wellbore conditions. Each sealed pack 12 placed within cavity 4 of downhole apparatus 2 may have any combination of any of the above-described features. Vacuum sealed packs 12 are commercially available from Newell Brands under the brand name FoodSaver® Vacuum Seal bags which come in the following sizes: 11"×16", Quart, 8"×20", 11"×12", and 8"×15". Sealed packs 12 may be sealed by conventional vacuum sealing machines including those available from Newall Brands under the FoodSaver® brand.

Figure 6:
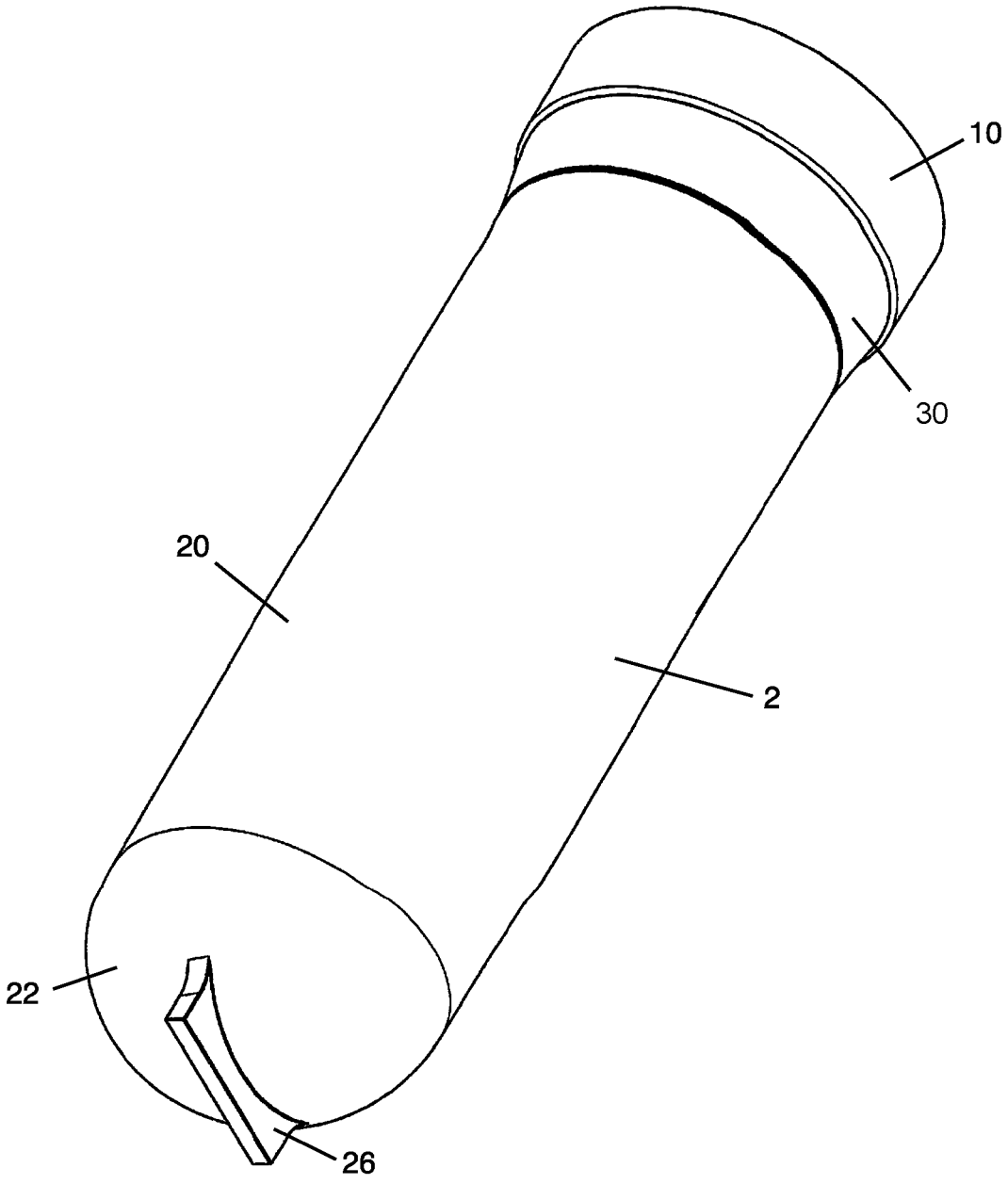
FIG. 6 is a perspective view of another embodiment of the downhole apparatus without fluid ports.
Figure 7:
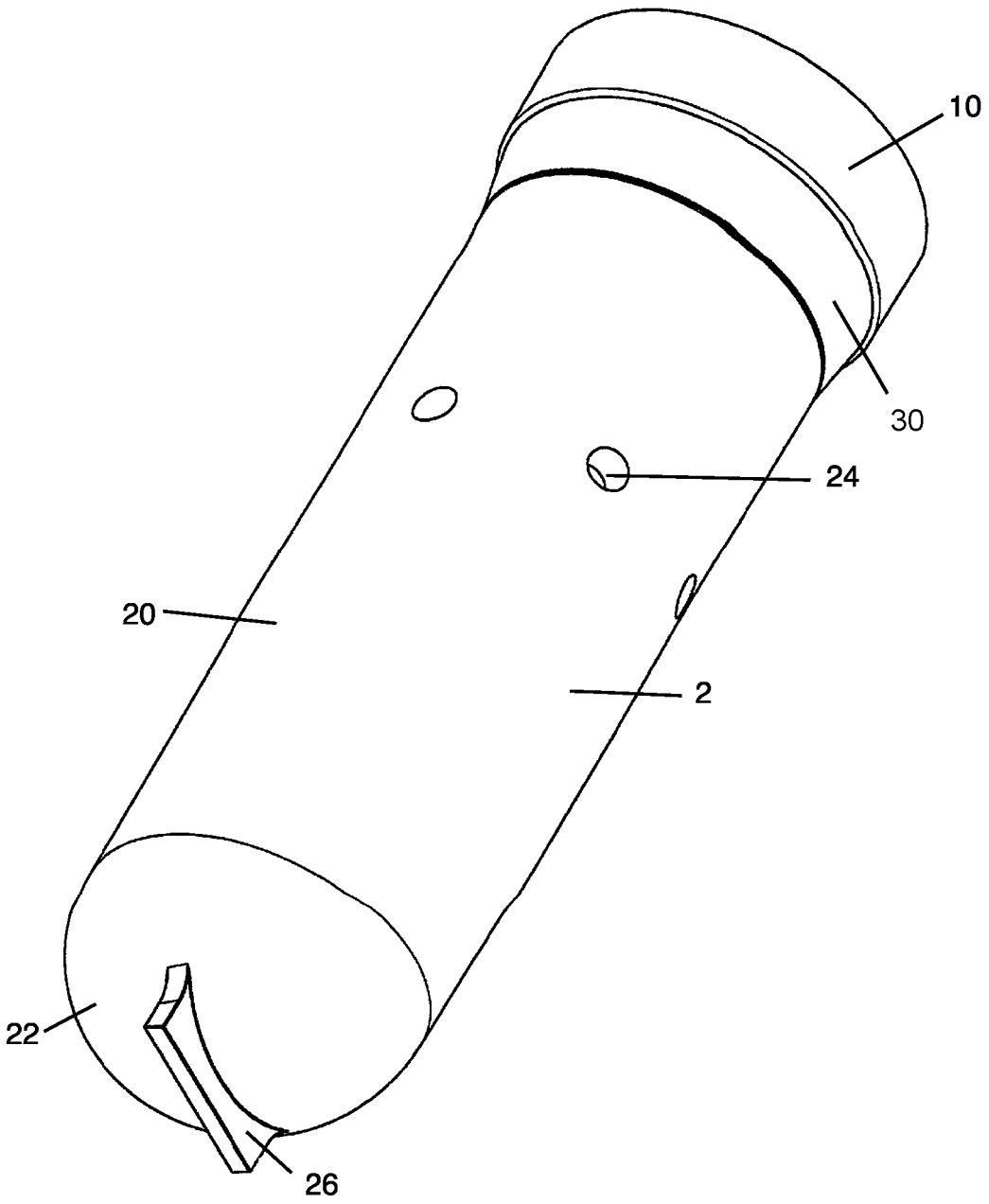
FIG. 7 is a perspective view of the embodiment of the downhole apparatus with fluid ports.
Figure 8:
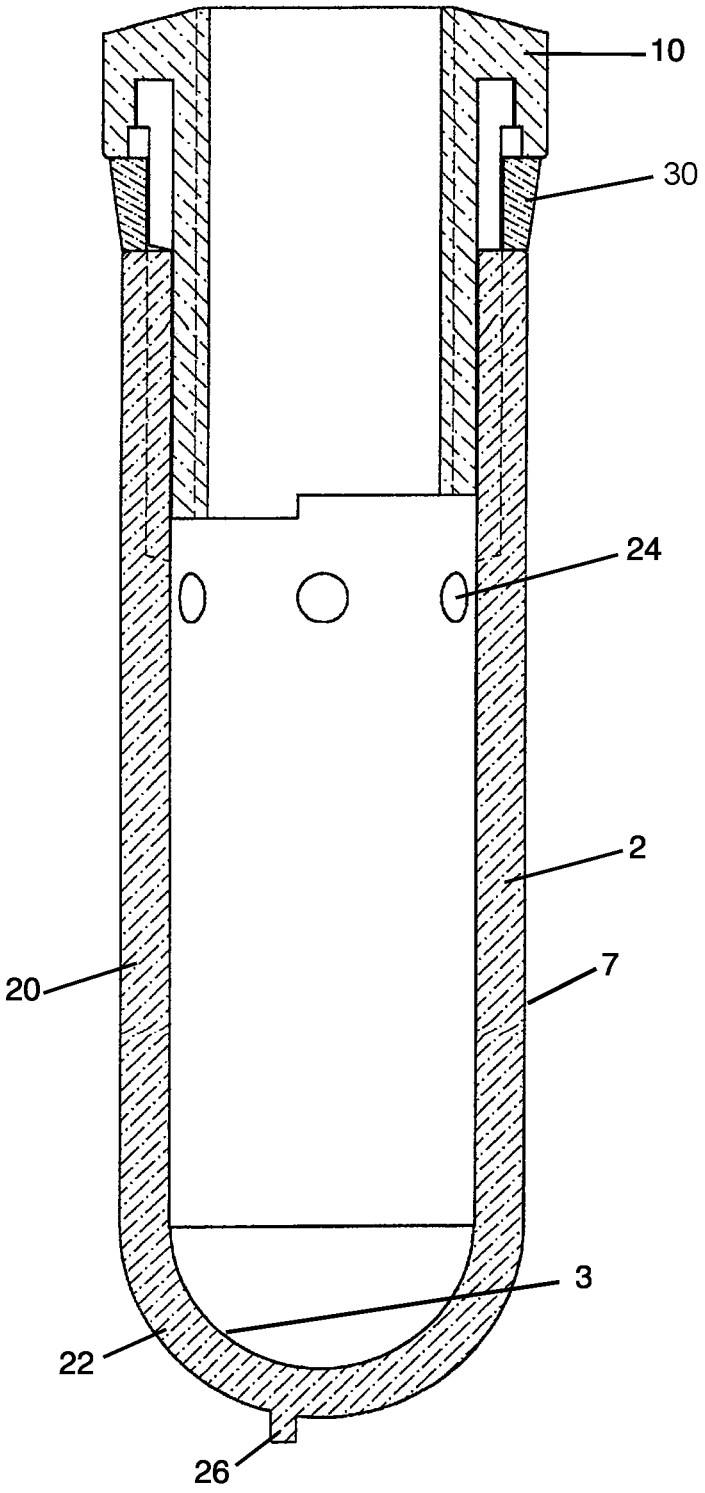
FIG. 8 is a partial sectional view of the downhole apparatus shown in FIG. 7.

As illustrated in FIGS. 6-8, downhole apparatus 2 is operatively connected at one end to shoe nut 10 and collar 30. Downhole apparatus 2 may be any shape with internal surface 3 defining cavity 4. For example, downhole apparatus 2 has a hollow cylindrical body 20 and a hollow hemispherical end 22. In alternate embodiments, downhole apparatus includes a flat end. In the embodiment depicted in FIG. 6, downhole apparatus 2 does not include any fluid ports 24. In the embodiment depicted in FIGS. 7-8, downhole apparatus 2 includes one or more fluid ports 24 so that cavity 4 is in fluid and therefore pressure communication with wellbore 100 (shown in FIGS. 35-37). Pressure communication means no differential pressure between the interior of downhole apparatus 2 and wellbore 100. In this way, cavity 4 is a communicating cavity. As shown in FIGS. 6-8, downhole apparatus 2 includes fixture 26 located at its lower or downhole end for allowing downhole apparatus 2 to operatively engage a second downhole apparatus 2 situated below the first downhole apparatus 2 as will be explained further herein. Alternatively, downhole apparatus 2 includes a mule shoe bottom for engaging the second downhole apparatus 2. The fixture and mule shoe bottom are discussed in detail further herein.

Figure 9:
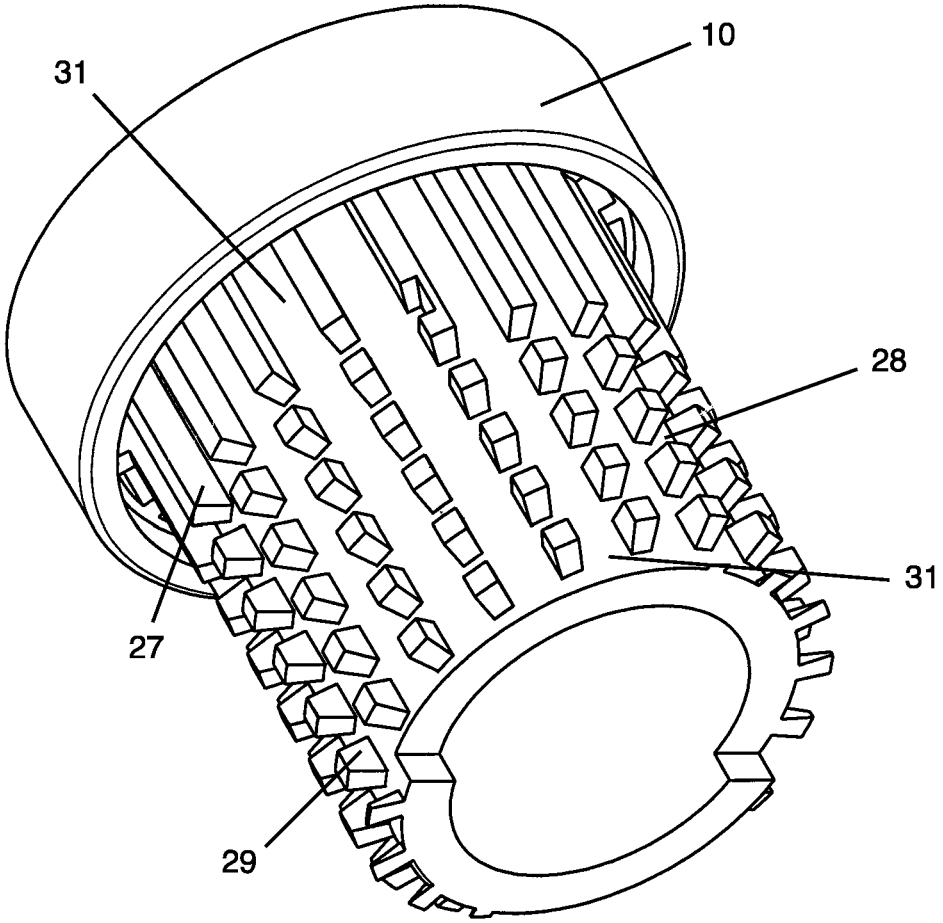
FIG. 9 is a perspective view of an embodiment of a shoe nut.
Figure 10:
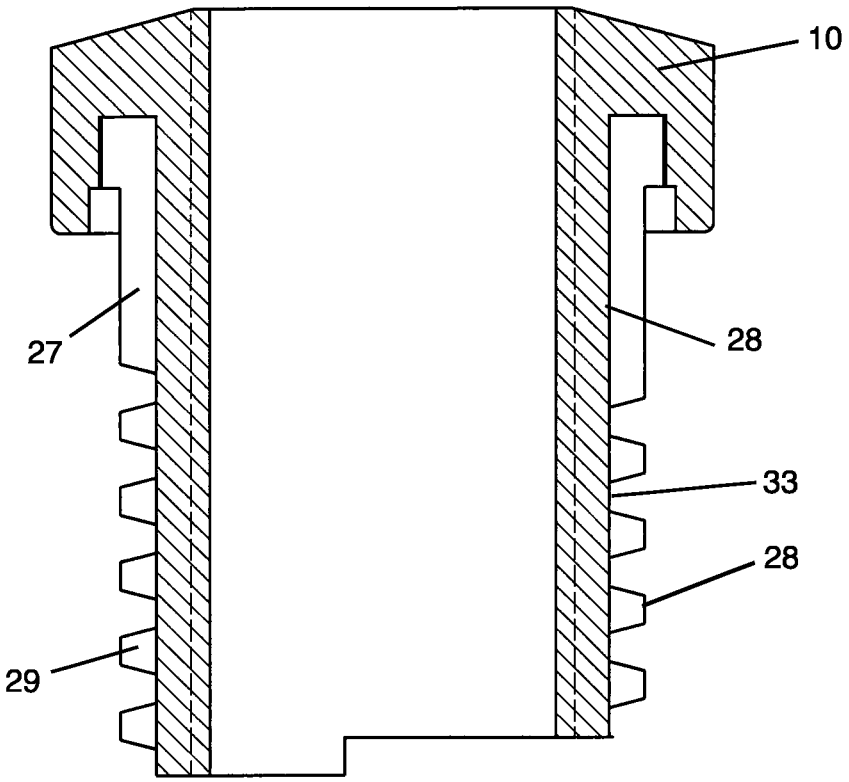
FIG. 10 is a sectional view of the shoe nut shown in FIG. 9.

Downhole apparatus 2 is connected to shoe nut 10. Downhole apparatus 2 and shoe nut are connected via any type of connection. For example, downhole apparatus 2 and shoe nut 10 are connected via threaded connection. Downhole apparatus 2 and shoe nut 10 are also connected via a 3.500-2 Full Acme thread. Other connections are shrink fit, glued connection, welded connection, bolted connection, clamped connection, and others. In the embodiment depicted in FIGS. 9-11, downhole apparatus 2 and shoe nut 10 are connected via connection arrangement 28 on shoe nut 10 (shown in FIGS. 9-10) and internal threads 35 on downhole apparatus 2 (shown on FIG. 11). As illustrated in FIGS. 9-10, connection arrangement 28 includes both a plurality of external axial guides 27 and a plurality of external protrusions 29. External protrusions 29 may be vertically aligned with external axial guides 27 such that components with internal axial guides (such as axial guides 40 depicted in FIG. 17) may slide onto shoe nut 10. In this arrangement, the internal axial guides of the component slide into the vertical spaces 31 (shown in FIG. 9) formed by external axial guides 27 and external protrusions 29 of shoe nut 10. External protrusions 29 may be horizontally arranged to mimic a thread such that components with internal threads may be threaded onto shoe nut 10. In this arrangement, the internal threads of the component rotate into the horizontal spaces 33 (shown in FIG. 10) formed by external protrusions 29 of shoe nut 10. In this way, shoe nut 10 may connect to components with either internal axial guides or internal threads.

Figure 11:
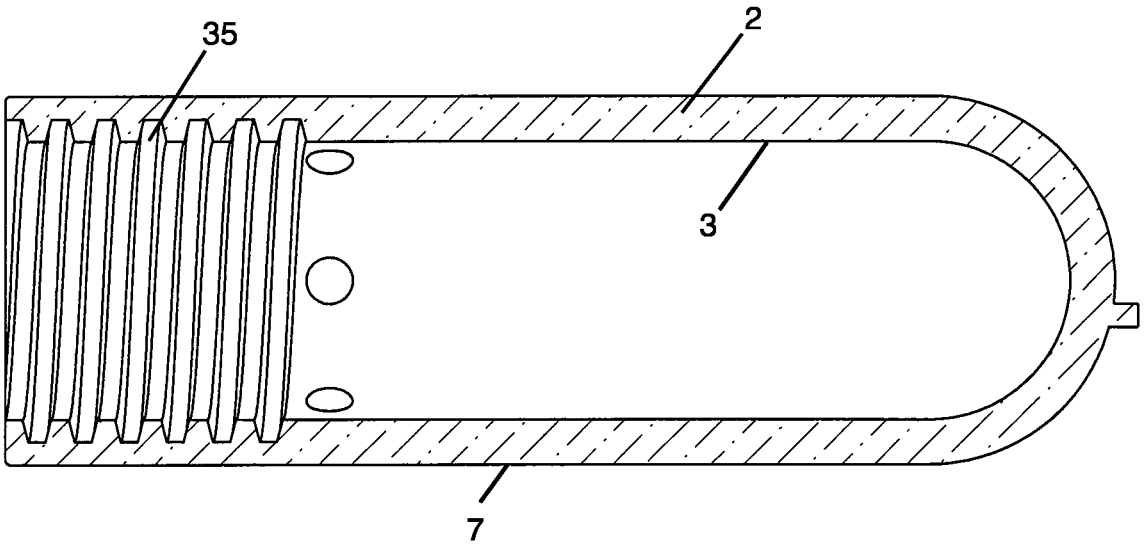
FIG. 11 is a sectional view of an embodiment of the downhole apparatus with fluid ports and connecting threads.
Figure 12:
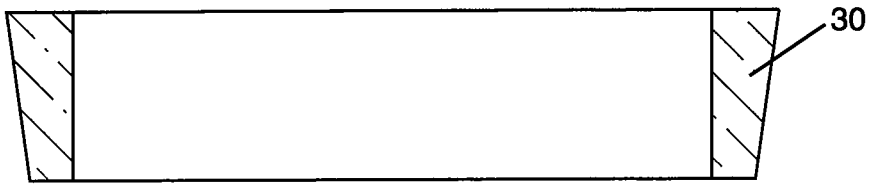
FIG. 12 is a sectional view of an embodiment of a collar.
Figure 13:
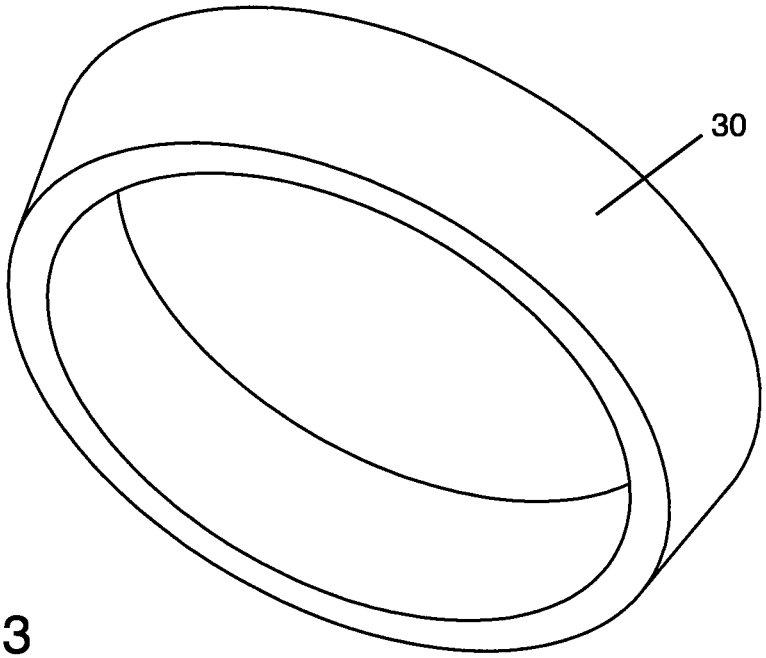
FIG. 13 is a perspective view of the collar shown in FIG. 12.

As illustrated in FIG. 11, downhole apparatus 2 includes internal threads 35 and is threadedly connected to shoe nut 10 via external protrusions 29 of shoe nut 10 (depicted in FIGS. 9-10). Collar 30, shown in FIGS. 12-13, acts as a spacer between shoe nut 10 and downhole apparatus 2 when downhole apparatus 2 is threadedly connected to shoe nut 10. In some embodiments, collar 30 may have internal axial guides on its interior surface for engaging external axial guides 27 of connection arrangement 28 of shoe nut 10. In other embodiments, collar 30 may have no thread on its interior surface so that collar 30 slides entirely over connection arrangement 28. As shown in FIG. 8, collar 30 has a tapered-out surface to smoothen the outer diameter difference between apparatus 2 and shoe nut 10.

Downhole apparatus 2, shoe nut 10, and collar 30 may be formed of any material, dissolvable or non-dissolvable. For example, the material may be fiberglass, carbon fiber, metal, elastomers such a nitrile rubber, or plastics such as thermoplastics and thermosets. Each of the above-described components may be made of different materials than the other components, and each component may be made of multiple materials.

An advantage of downhole apparatus 2 is its modular nature, i.e., the ability of a user to operatively connect downhole apparatus 2 to well-plugging assembly 5 (or other downhole tool) in the field by securing shoe nut 10 to mandrel 8 or the housing of well-plugging assembly 5, placing collar 30 onto shoe nut 10, and threadedly connecting downhole apparatus 2 to shoe nut 10. During this process, one or more sealed packs 12 containing chemicals 11 may be placed into cavity 4 of downhole apparatus 2. Another advantage is the user's ability to secure other accessories to shoe nut 10 in the field. Additional accessories are a centralizer assembly, a bumper assembly, or a bridge-plug adapter assembly. These additional components are discussed in turn below.

Figure 14:
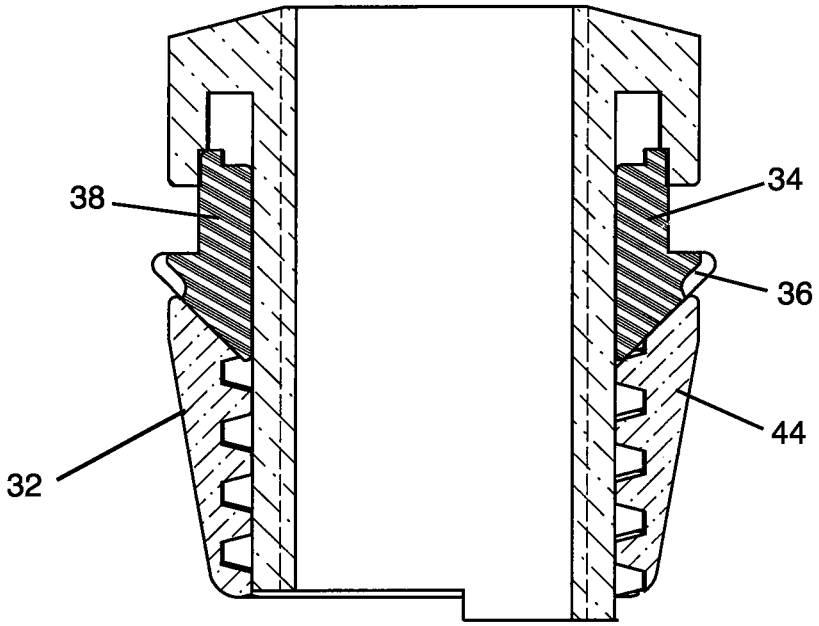
FIG. 14 is a sectional view of an embodiment of a centralizer assembly.
Figure 15:
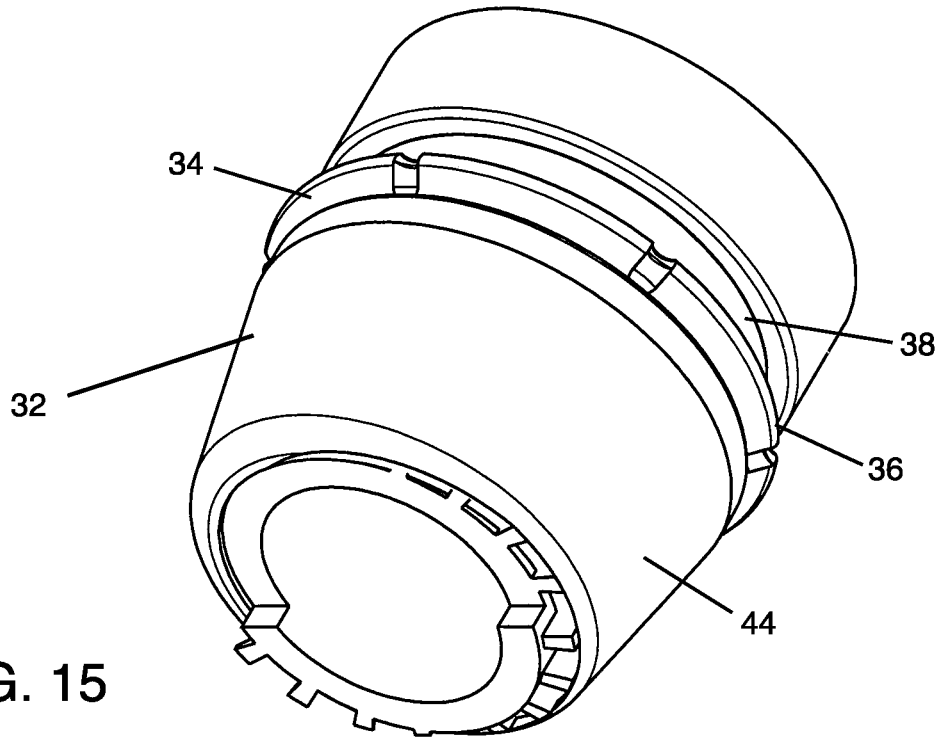
FIG. 15 is a perspective view of the centralizer assembly shown in FIG. 14.
Figure 16:
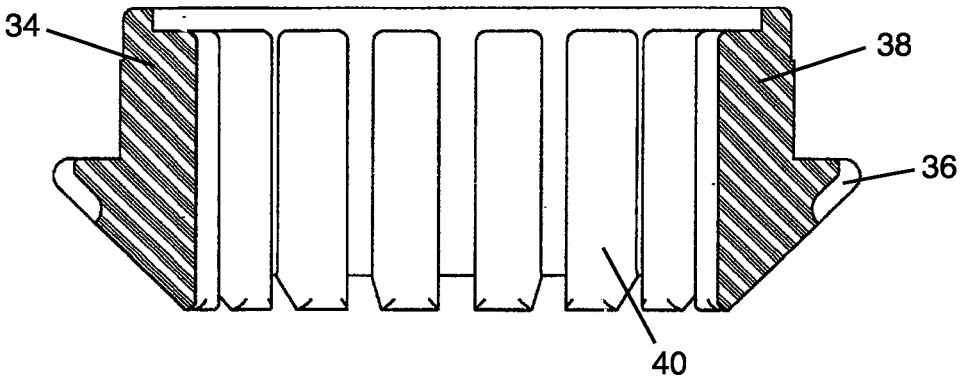
FIG. 16 is a sectional view of the centralizer of the centralizer assembly shown in FIG. 14.
Figure 17:
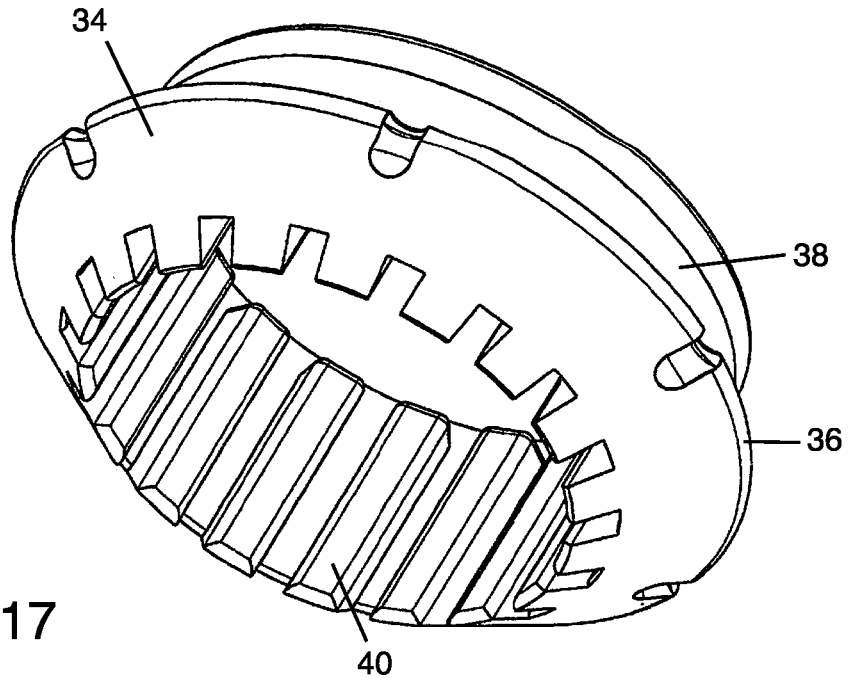
FIG. 17 is a perspective view of the centralizer shown in FIG. 16.

FIGS. 14-17 illustrate centralizer assembly 32, which also can be utilized as a wiper element when running into and out of wellbore 100. Centralizer assembly 32 includes centralizer 34 having fin extension 36 extending radially outward from main body 38 such that an outer diameter of fin extension 36 is greater than an outer diameter of main body 38 of centralizer 34. Referring specifically to FIGS. 16-17, centralizer 34 includes internal axial guides 40 corresponding with external axial guides 27 of shoe nut 10 (shown in FIG. 9). When centralizer 34 is placed on shoe nut 10, internal axial guides 40 of centralizer 34 align with external axial guides 27 of shoe nut 10 thereby preventing rotation of centralizer 34 relative to shoe nut 10. Centralizer assembly 32 includes retaining collar 44 for retaining centralizer 34 on shoe nut 10 as shown in FIGS. 14-15. Retaining collar 44 includes matching threads with shoe nut 10 so that retaining collar 44 threadedly secures to shoe nut 10. Centralizer assembly 32 is also configured to keep downhole apparatus 2 positioned in the center of wellbore 100.

Figure 18:
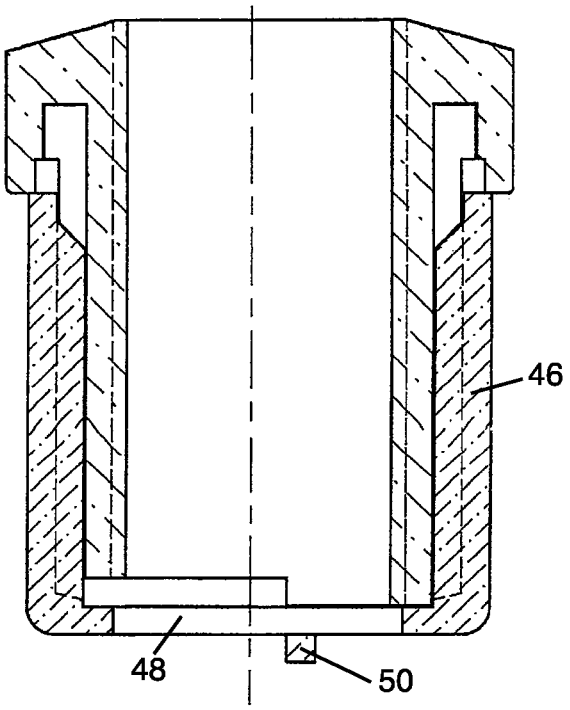
FIG. 18 is a sectional view of an embodiment of a bumper assembly.
Figure 19:
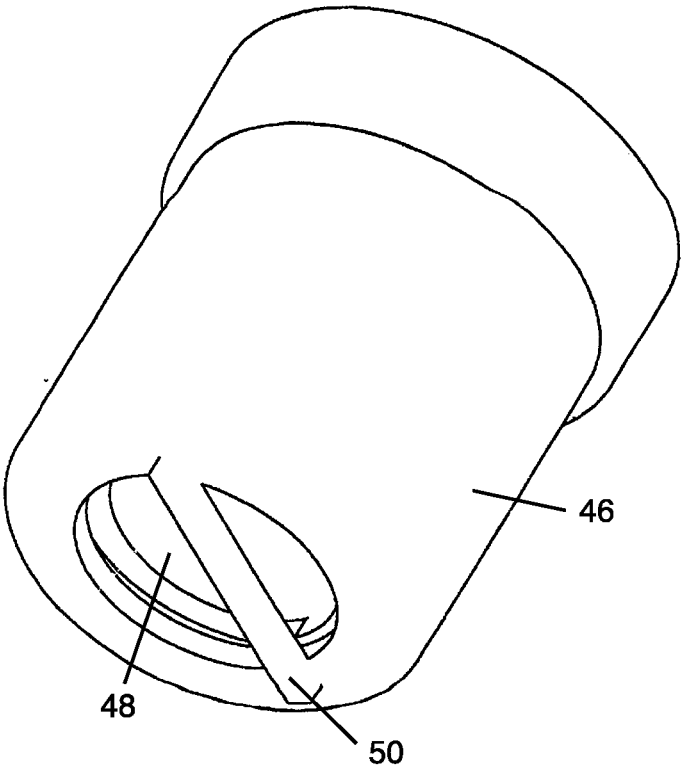
FIG. 19 is a perspective view of the bumper assembly shown in FIG. 18.

FIGS. 18-19 illustrate bumper assembly 46, which includes opening 48 for allowing fluid flow therethrough. Bumper 46 also includes fixture 50 or alternatively a mule shoe bottom for engaging a second or successive well-plugging assembly 5 with connected downhole apparatus 2 in wellbore 100. Bumper assembly 46 is a bottom hole bumper for protecting the first well-plugging assembly 5 from damage by absorbing any downward impact encountered by the first well-plugging assembly 5 in wellbore 100 as it encounters the toe shoe of the wellbore 100 in case of an over-running occurrence into the hole.

Figure 20:
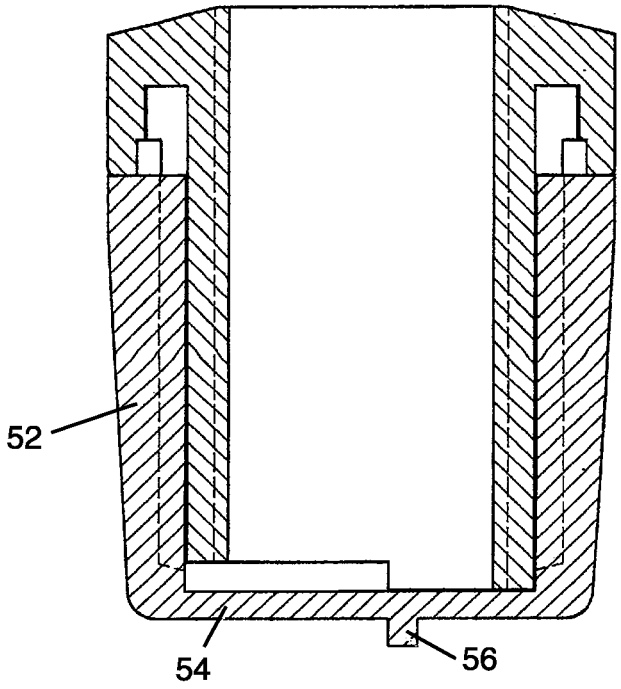
FIG. 20 is a sectional view of an embodiment of a bridge plug adapter assembly.
Figure 21:
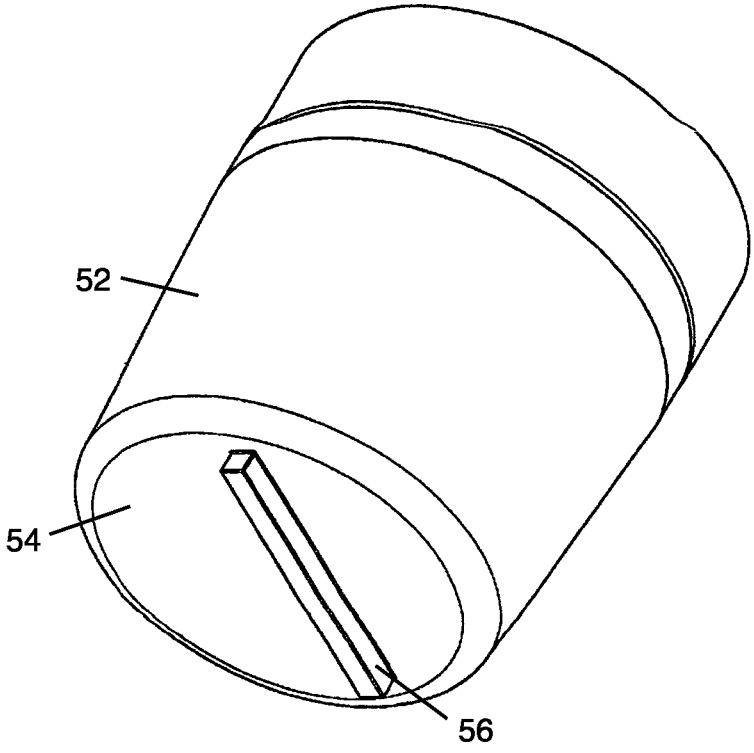
FIG. 21 is a perspective view of the bridge plug adapter assembly shown in FIG. 20.

FIGS. 20-21 illustrate bridge-plug adapter assembly 52, which includes sealing wall 54 for preventing fluid flow therethrough. Bridge-plug adapter assembly 52 includes fixture 56 or alternatively a mule shoe bottom for engaging a second or successive downhole tools. Bridge plug adapter assembly 52 converts a frac plug into a bridge plug by sealing off any fluid flow through an inner bore of the frac plug.

Figure 22:
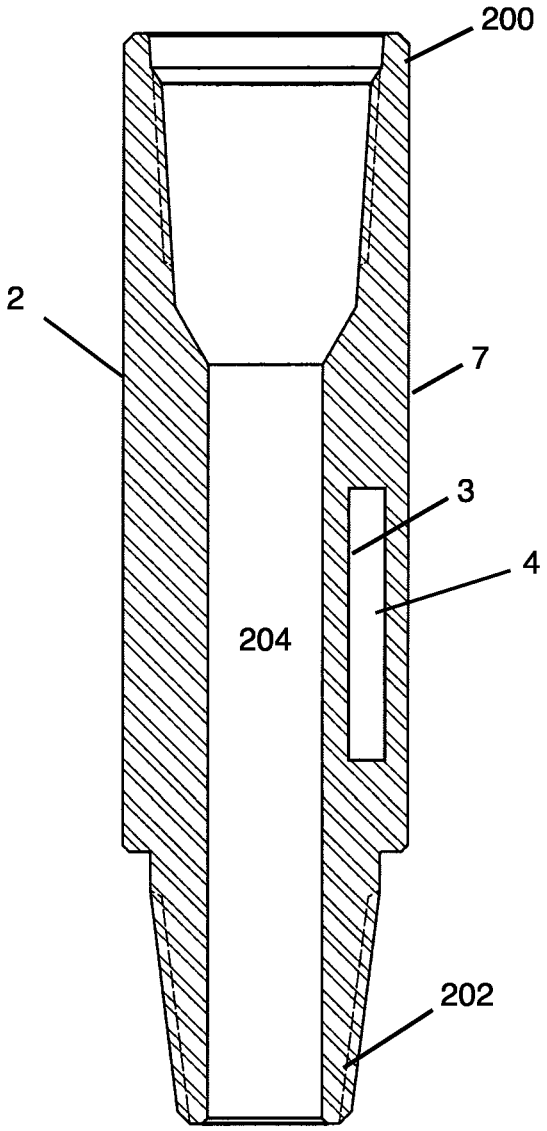
FIG. 22 is a sectional view of another embodiment of the downhole apparatus with a discrete internal cavity.

FIG. 22 presents another embodiment of downhole apparatus 2. In this embodiment, downhole apparatus 2 includes box end 200 and pin end 202 with threaded connections for connection to tubulars (e.g., drill string, coiled tubing, or tubular string) or downhole tools. Downhole apparatus 2 includes a bore 204 for the passage of fluid. Outer surface 7 is cylindrical. Downhole apparatus 2 includes internal surface 3 defining cavity 4, which in FIG. 22 is shown empty. However, it is to be understood that consistent with the disclosure herein, one or more sealed packs 12 containing chemicals 11 are placed within cavity 4. It should also be understood that while downhole apparatus 2 is shown with only one cavity 4, apparatus 2 could include additional cavities 4 for housing chemicals. In this embodiment, cavity 4 of downhole apparatus 2 is configured integral with the sidewall of apparatus 2 and forms a recess within the sidewall. Access to cavity 4 for the placement of sealed packs 12 is provided by numerous mechanisms. For example, downhole apparatus 2 has a detachable (e.g., threaded) opening or bore (not shown) that provides access to cavity 4 and which can be closed in a sealed manner.

Alternatively, downhole apparatus 2 has a cover plate (not shown) operatively associated with cavity 4 that is detachably secured to an external opening of cavity 4 by bolts, screws, welds, or other means. Alternatively, downhole apparatus 2 is configured as two separate components, a top sub and a bottom sub (not shown), which when separated expose cavity 4 for placement of sealed packs 12 and thereafter may be detachably secured (e.g., screwed, threaded, or bolted together) to form downhole apparatus 2 and enclosed cavity 4. Downhole apparatus 2 is milled to release the chemicals 11 in sealed packs 12 or configured with a mechanism to expose cavity 4 and sealed packs 12 to environmental conditions or dissolving agents to dissolve sealed packs 12 to release the chemicals 11.

Figure 23:
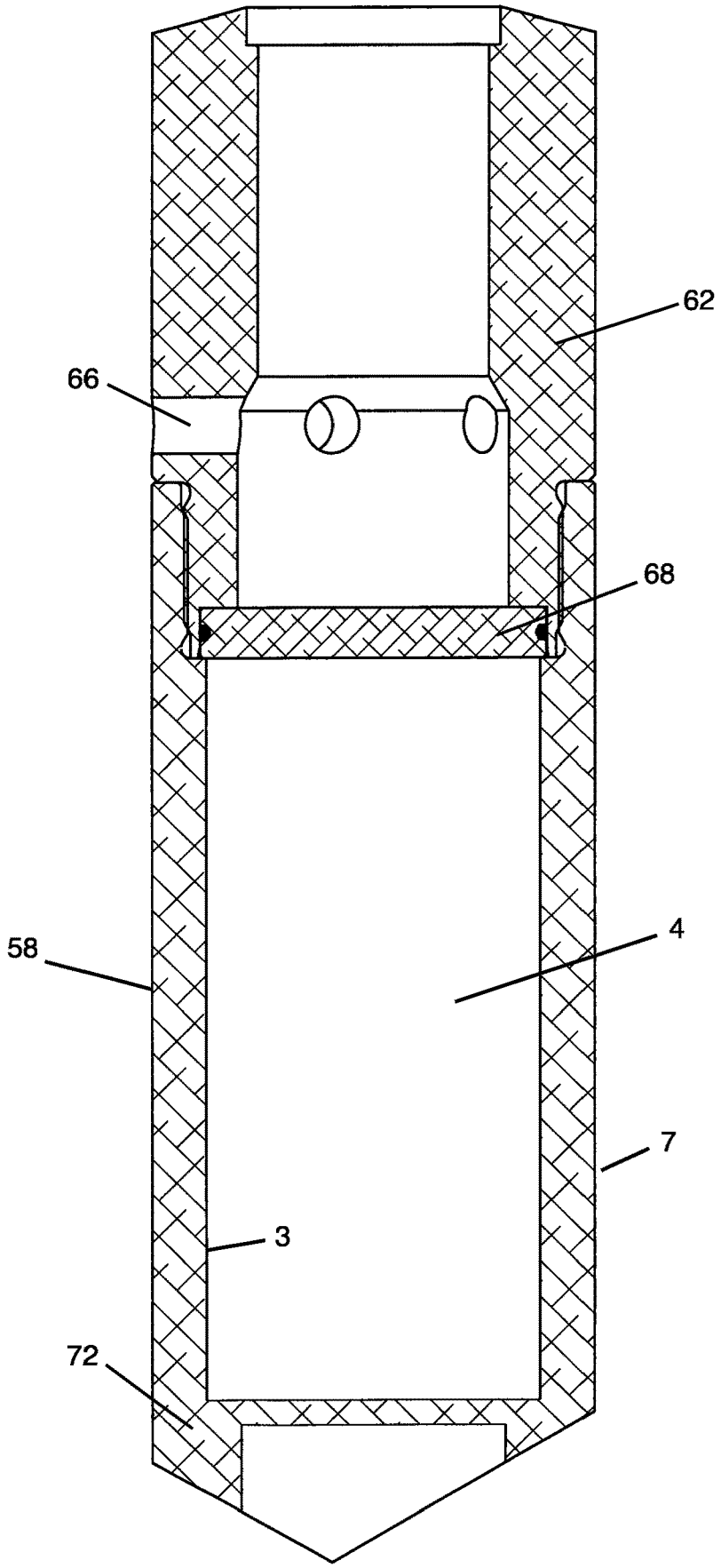
FIG. 23 is a sectional view of another embodiment of the downhole apparatus with retaining plates but without fluid ports.
Figure 24:
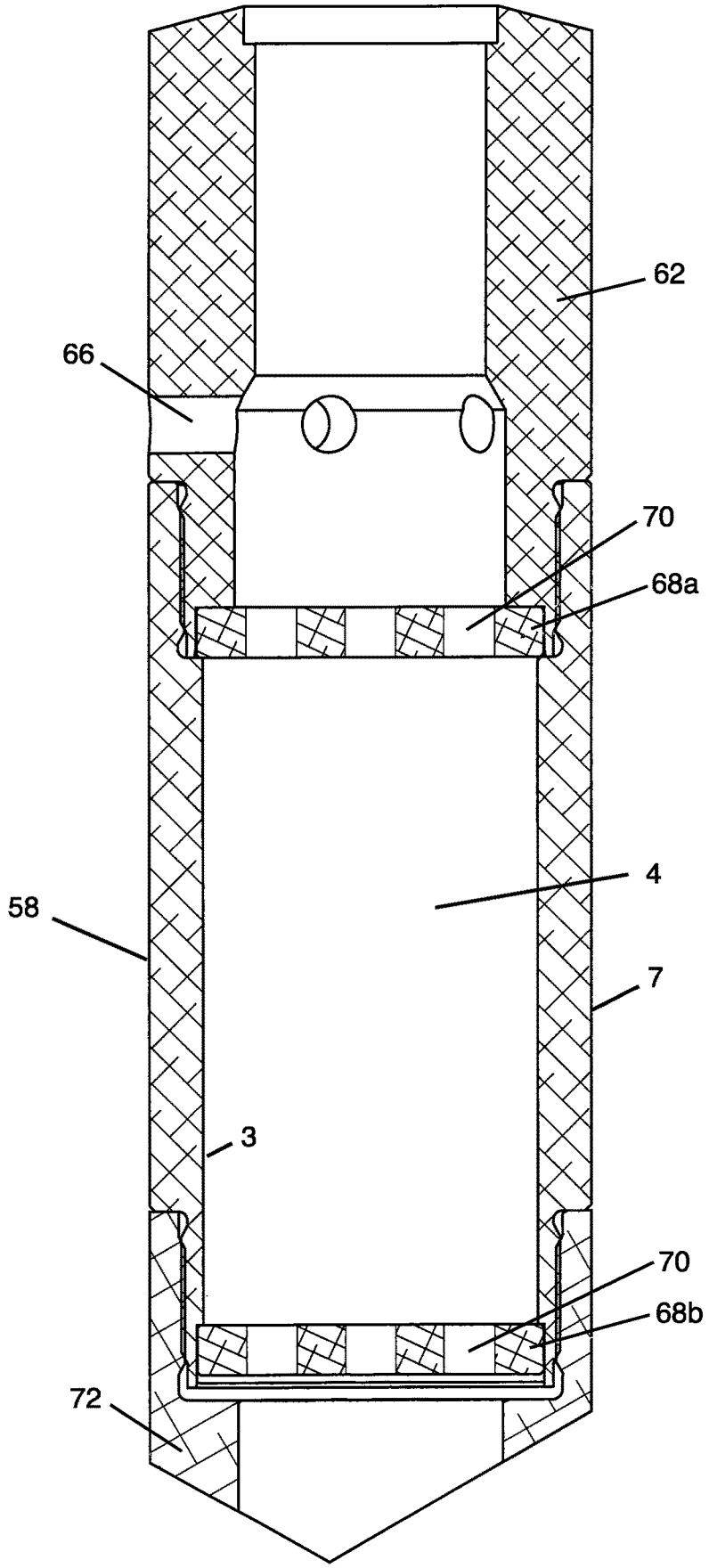
FIG. 24 is a sectional view of another embodiment of the downhole apparatus with retaining plates and with fluid ports.
Figure 25:
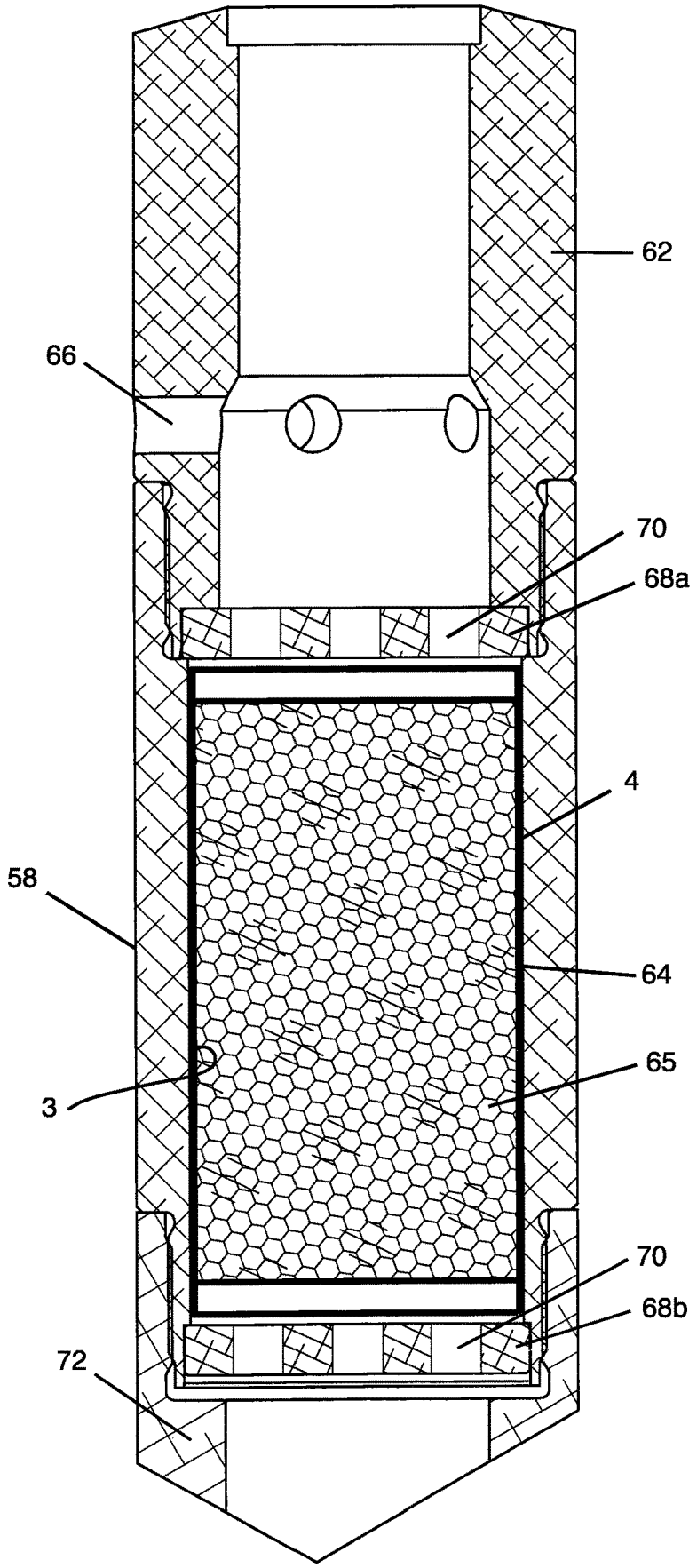
FIG. 25 is a sectional view of the downhole apparatus shown in FIG. 24 with a sealed chemical pack.

FIGS. 23-25 illustrate another embodiment of the downhole apparatus. Downhole apparatus 58 has internal surface 3 defining cavity 4. Downhole apparatus 58 is connected to a downstream end of the housing or mandrel 8 (not shown) of a downhole tool such as well-plugging assembly 5 via shoe nut 62. As shown in FIG. 25, downhole apparatus 58 includes sealed pack 64 containing chemicals 65. In other embodiments, downhole apparatus 58 includes two or more sealed packs 64. Sealed packs 64 may be configured in any shape and may include any number of sealed ends. Sealed pack 64 may be vacuum sealed and may include any number of flexible sides. In an embodiment including more than one sealed pack 64, each pack 64 may have any combination of the above-described features.

As illustrated in FIGS. 23-25, downhole apparatus 58 is threadedly connected to shoe nut 62. Shoe nut 62 may be identical in structure to shoe nut 10 discussed above, but in the present embodiment, shoe nut 62 includes one or more fluid ports 66 to allow for fluid communication with wellbore 100.

Again with reference to FIGS. 23-25, downhole apparatus 58 may be any shape having a hollow interior, as for example, a hollow cylinder. Downhole apparatus 58 includes one or more stationary retaining plates 68 for retaining the one or more sealed packs 64 within cavity 4. In the embodiment depicted in FIG. 23, downhole apparatus 58 includes one stationary retaining plate 68. In the embodiment depicted in FIG. 24, downhole apparatus 58 includes two stationary retaining plates 68, specifically an upstream retaining plate 68*a* and a downstream retaining plate 68*b*. Each stationary retaining plate 68 may or may not include fluid ports 70. In the embodiment depicted in FIG. 23, stationary retaining plate 68 does not include fluid ports 70 such that cavity 4 is pressure and fluid sealed to wellbore 100. Alternatively, in the embodiment depicted in FIG. 25, upstream stationary retaining plate 68*a* and downstream retaining plate 68*b* may include fluid ports 70 so that cavity 4 is in fluid communication with wellbore 100. In this way, cavity 4 is a communicating cavity. In other embodiments, stationary upstream retaining plate 68*a* and downstream retaining plate 68*b* may include no fluid ports 70 at all so that cavity 4 is pressure and fluid sealed to wellbore 100. Downhole apparatus 58 further includes mule shoe bottom 72 located at its downhole end for allowing the downhole apparatus 2 to operatively engage or connect to a second or successive downhole tool such as a second well-plugging assembly 5. Alternatively, downhole apparatus 58 includes a fixture for engaging or connecting to a second or successive downhole tool such as a second well-plugging assembly 5. The function of the mule shoe bottom 72 or fixture is described in detail further herein.

Figure 26:
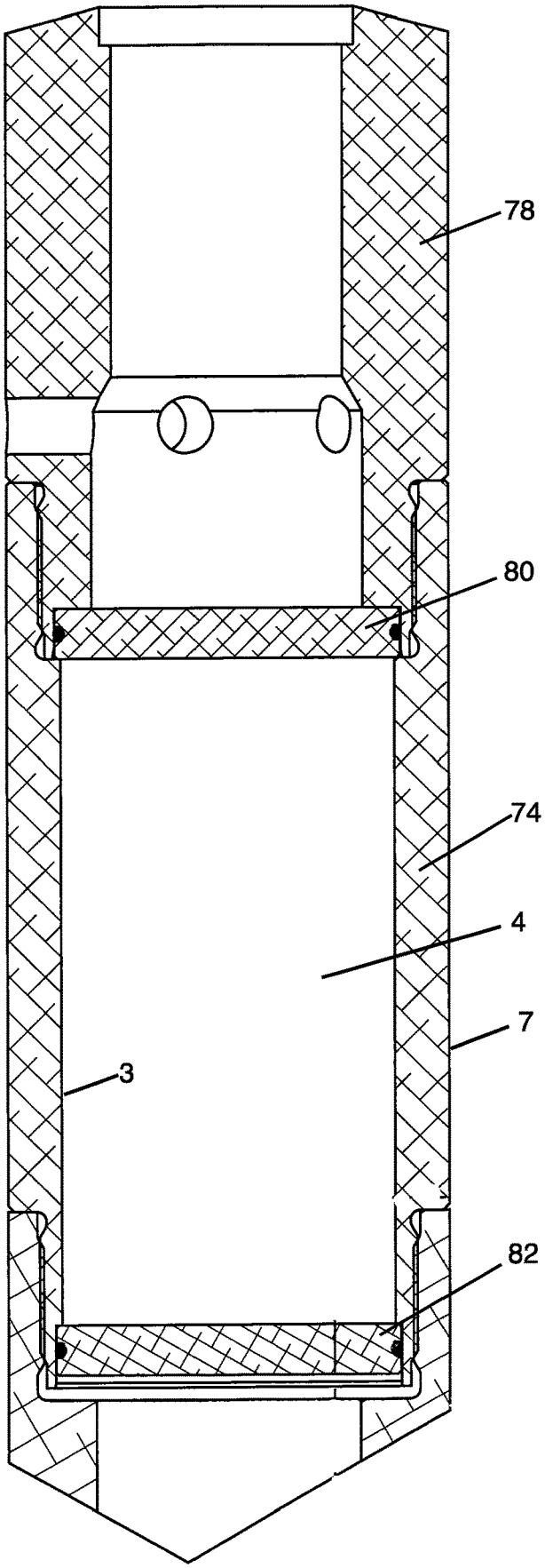
FIG. 26 is a sectional view of another embodiment of the downhole apparatus with a compensating piston.
Figure 27A:
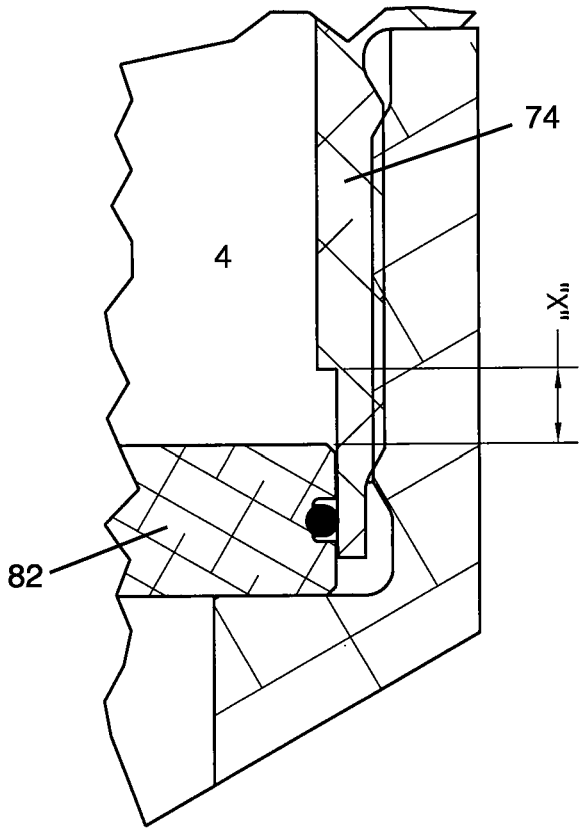
FIG. 27A is a longitudinal section of the lower portion of the downhole apparatus shown in FIG. 26 with the sliding sealing plate in the downward position.
Figure 27B:
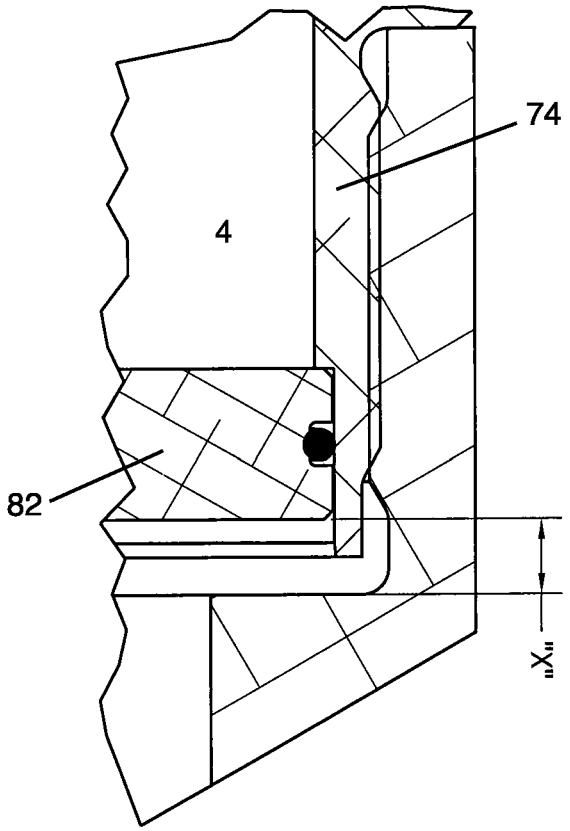
FIG. 27B is the longitudinal section shown in FIG. 27A with the sliding sealing plate in the upward position.

FIGS. 26-27B illustrate another embodiment of the downhole apparatus that does not provide fluid communication between cavity 4 and wellbore 100. Instead, the downhole apparatus is configured whereby the volume and interior pressure of cavity 4 is adjusted in response to downhole conditions. In this way, cavity 4 is a communicating cavity. As shown in FIG. 26, downhole apparatus 74 includes internal surface 3 defining cavity 4. Downhole apparatus 74 is connected to the housing or mandrel 8 (not shown) of a downhole tool, such as well-plugging assembly 5 (not shown), via shoe nut 78. Downhole apparatus 74 includes one or more sealed packs 12 containing chemicals 11 (not shown). As discussed in detail above, the one or more sealed packs 12 may be any shape and may include any number of sealed ends. The one or more sealed packs 12 may be vacuum sealed and may include any number of flexible sides. In an embodiment including more than one sealed pack 12, each sealed pack 12 may have any combination of the above-described features.

Again with reference to FIGS. 26-27B, downhole apparatus 74 may be any shape having a hollow interior, such as a hollow cylinder. Downhole apparatus 74 includes stationary sealing plate 80 at its upstream end and sliding sealing plate 82 at its downstream end for retaining the one or more sealed packs 12 within cavity 4. In this embodiment, stationary sealing plate 80 and sliding sealing plate 82 do not include fluid ports 70; thus, cavity 4 is not in fluid communication with wellbore 100.

While stationary sealing plate 80 is stationary in relation to internal surface 3 of downhole apparatus 74, sliding sealing plate 82 may slide axially in relation to internal surface 3 of downhole apparatus 74. Referring specifically to FIGS. 27A-27B, sliding sealing plate 82 may move axially downward in response to an increased pressure within cavity 4 due to gas expansion in downhole conditions, e.g., increased wellbore temperature. The overall length of downhole apparatus 74 is increased by "x" thereby increasing the internal volume of cavity 4. In this way, sliding sealing plate 82 acts as a compensating piston. Additionally, sliding sealing plate 82 may move axially upward in response to an increased hydrostatic pressure in wellbore 100 caused by, for example, increased drilling or completion mud weight or increased true vertical depth of the well-plugging assembly 5. One advantage of downhole apparatus 74 is its modular nature. A user in the field is able to secure shoe nut 78 to a downstream end of the housing or mandrel 8 of a downhole tool such as well-plugging assembly 5 and secure downhole apparatus 74 to shoe nut 78.

Figure 28:
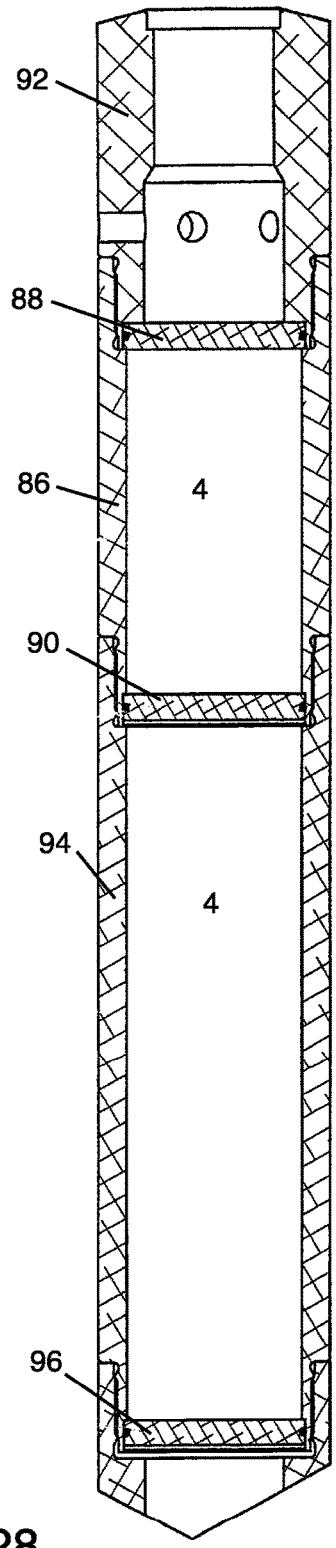
FIG. 28 is a sectional view of another embodiment of the downhole apparatus with two cavities and two compensating pistons.
Figure 29:
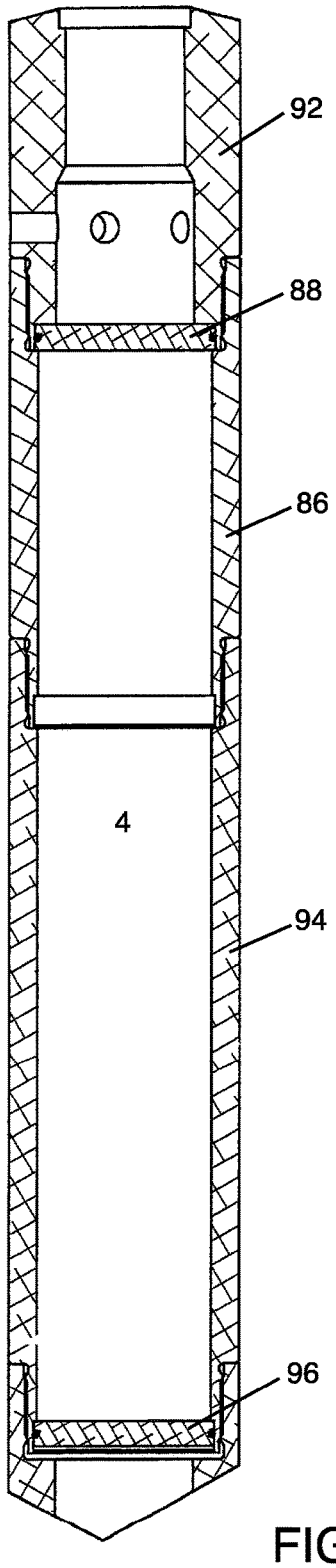
FIG. 29 is a sectional view of another embodiment of the downhole apparatus with a first cavity without a compensating piston and a second cavity with a compensating piston.

As depicted in FIGS. 28-29, a user can further customize the downhole apparatus by successively securing additional downhole apparatuses thereto. For example, as shown in FIG. 28, a user may secure a first downhole apparatus 86 having stationary sealing plate 88 and first slidable sealing plate 90 to shoe nut 92. A user may then secure a second downhole apparatus 94 having a second slidable sealing plate 96 to first downhole apparatus 86. In this way, communicating cavities 4 are formed, with first slidable sealing plate 90 and second slidable sealing plate 96 acting as compensating pistons. Alternatively, a user may choose to omit the first slidable sealing plate so that a larger continuous communicating cavity is formed, as shown in FIG. 29. In this configuration, second slidable sealing plate 96 acts as a compensating piston. A user may secure additional containers, with or without slidable sealing plates therebetween, to further downhole apparatus 74.

Figure 30:
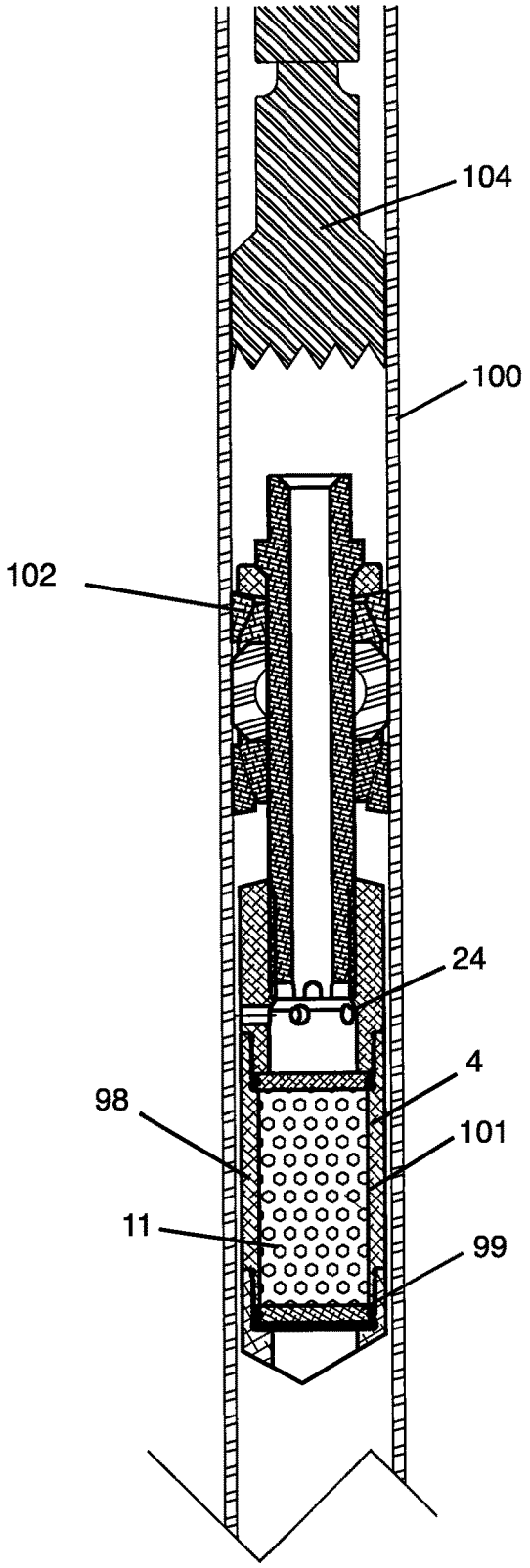
FIG. 30 is a first sequential, sectional view of a first downhole apparatus operatively connected to a first well-plugging assembly disposed within the wellbore during milling operations.
Figure 31:
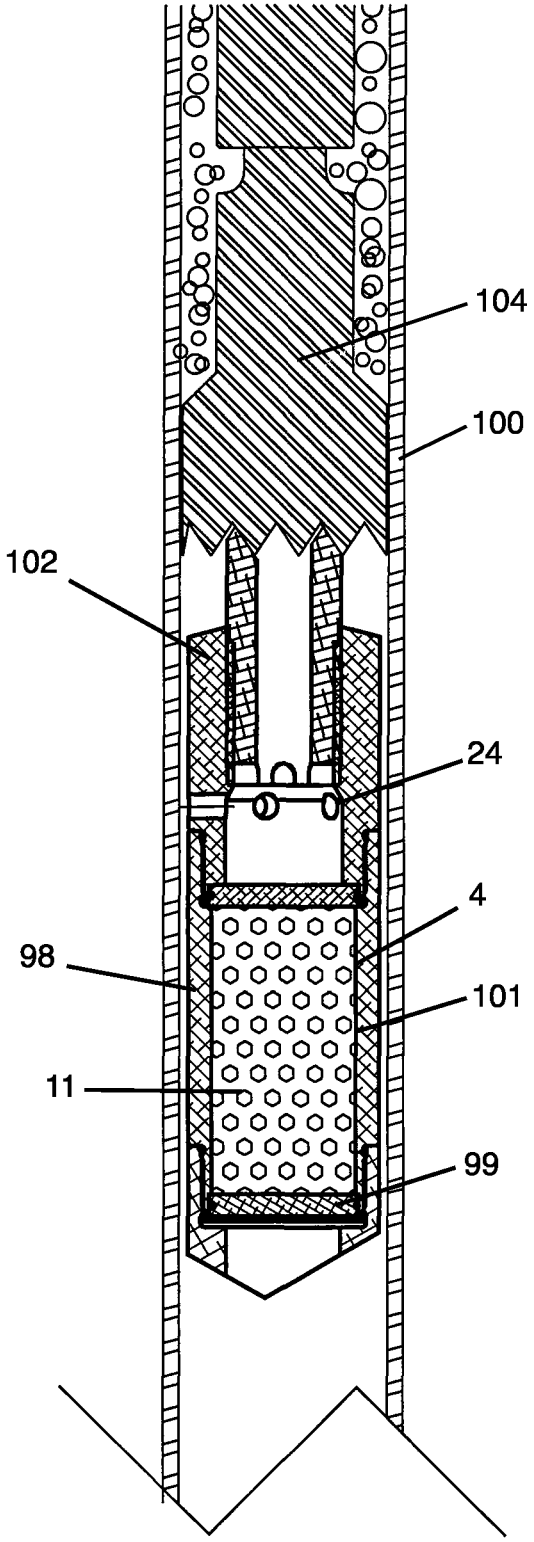
FIG. 31 is a second sequential, sectional view of the first well-plugging assembly as shown in FIG. 30 being milled resulting in the release of the first downhole apparatus.

FIGS. 30-34 illustrate the above-described embodiments of downhole apparatus in operation. FIG. 30 depicts first downhole apparatus 98 with internal surface 3 defining first cavity 4 and having compensating piston 99. First downhole apparatus 98 is disposed within wellbore 100. It is to be understood that wellbore 100 is the bore formed in oil or gas well by either the internal wall of the formation, the internal wall of the wellbore casing, or the internal wall of other wellbore tubulars. First downhole apparatus 98 may have fluid ports 24 as illustrated in FIGS. 7-8 or fluid ports 70 as illustrated in FIGS. 21-22. Alternatively, first downhole apparatus 98 may have no fluid ports and no compensating pistons, as in FIG. 23, such that cavity 4 is fluid and pressure sealed. As shown in FIG. 30, first downhole apparatus 98 is secured to a downstream end of first frac plug 102. Referring now to FIG. 31, when milling device 104 is introduced into wellbore 100, milling device 104 may begin milling an upstream end of first frac plug 102 until first frac plug 102 detaches from the wellbore 100, casing, or tubing. At this point, the mechanisms securing first frac plug 102 to wellbore 100 have been milled and first downhole apparatus 98 may begin descending wellbore 100 until it reaches the next, second, or successive downhole tool, which may be a second frac plug 106.

Figure 32:
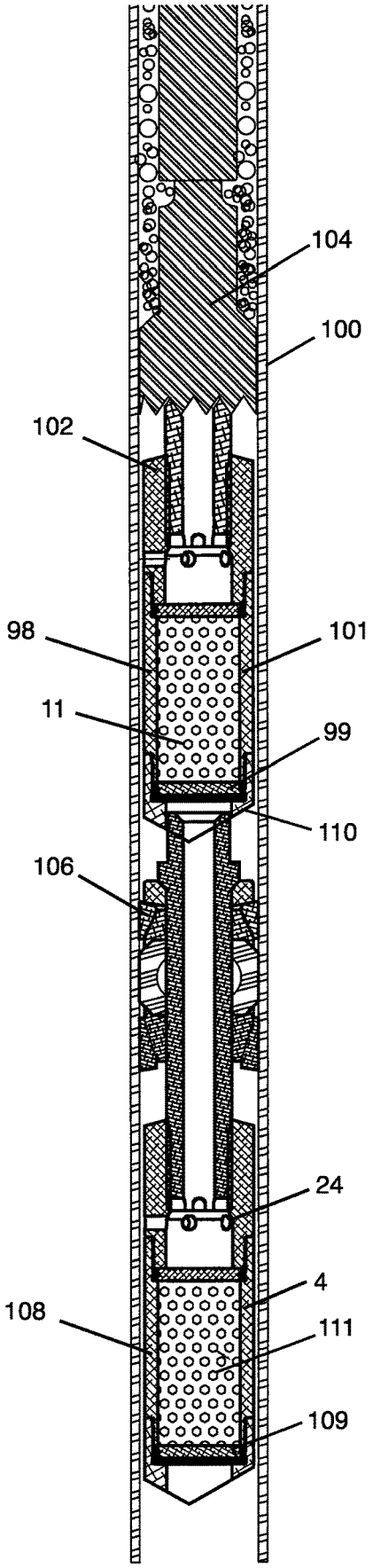
FIG. 32 is a third sequential, sectional view of the first downhole apparatus as shown in FIG. 31 now operatively positioned above a second well-plugging assembly which is operatively connected to a second downhole apparatus disposed within the wellbore during milling operations.

As shown in FIG. 32, first downhole apparatus 98 may descend wellbore 100 until it reaches, for example, second frac plug 106, which may include second downhole apparatus 108 with cavity 4 and compensating piston 109. Second downhole apparatus 108 may have fluid ports 24 as illustrated in FIGS. 7-8 or fluid ports 70 as illustrated in FIGS. 21-22. Alternatively, second downhole apparatus 108 may have no fluid ports and no compensating piston, as in FIG. 23, such that cavity 4 is fluid and pressure sealed. After its descent, first downhole apparatus 98 operatively engages an upstream end of second frac plug 106, as for example, mule shoe bottom 110 of first downhole apparatus 98 engages the upstream end of second frac plug 106 to prevent the first downhole apparatus 98 from rotating with milling device 104. In other embodiments, first downhole apparatus 98 may alternatively have a fixture, such as fixture 26 illustrated in FIGS. 7-9, for engaging second frac plug 106 to prevent rotation of first downhole apparatus 98 as it is milled.

Figure 33:
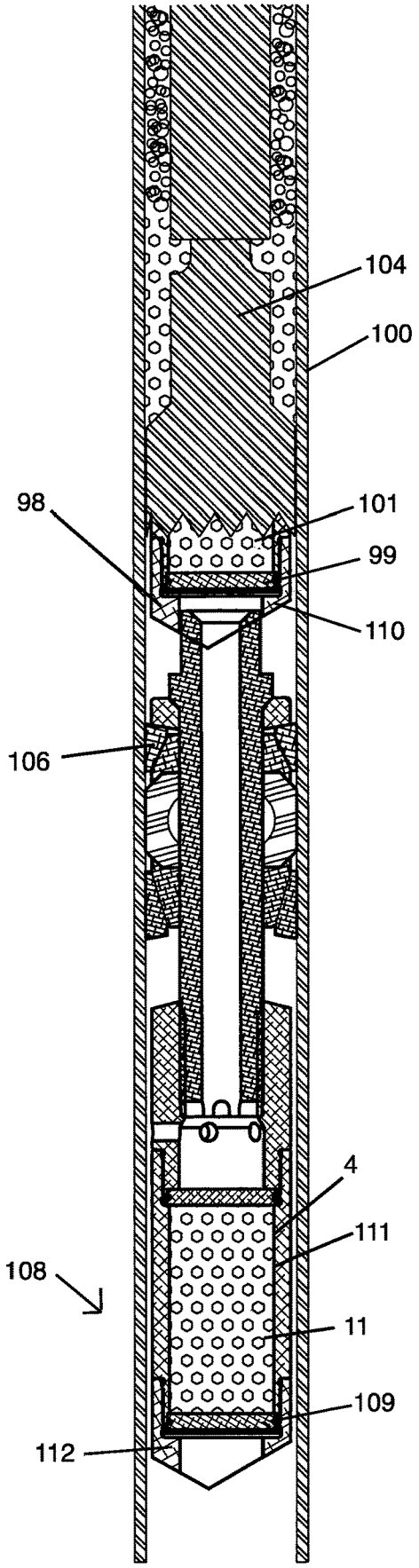
FIG. 33 is a fourth sequential, sectional view of the first downhole assembly as shown in FIG. 32 being milled to cause release of the chemicals contained within the sealed chemical pack during milling operations.

As illustrated in FIG. 33, the chemicals 11 disposed within sealed pack 101 of first downhole apparatus 98 will be released as first downhole apparatus 98 is milled. By way of example only, the chemicals 11 may be a suspension agent for aiding in the suspension and removal of the milled particles of frac plug 106. The chemical substance may alternatively include friction reduction agents, emulsifiers, corrosion inhibitors, acids, and thinners.

Figure 34:
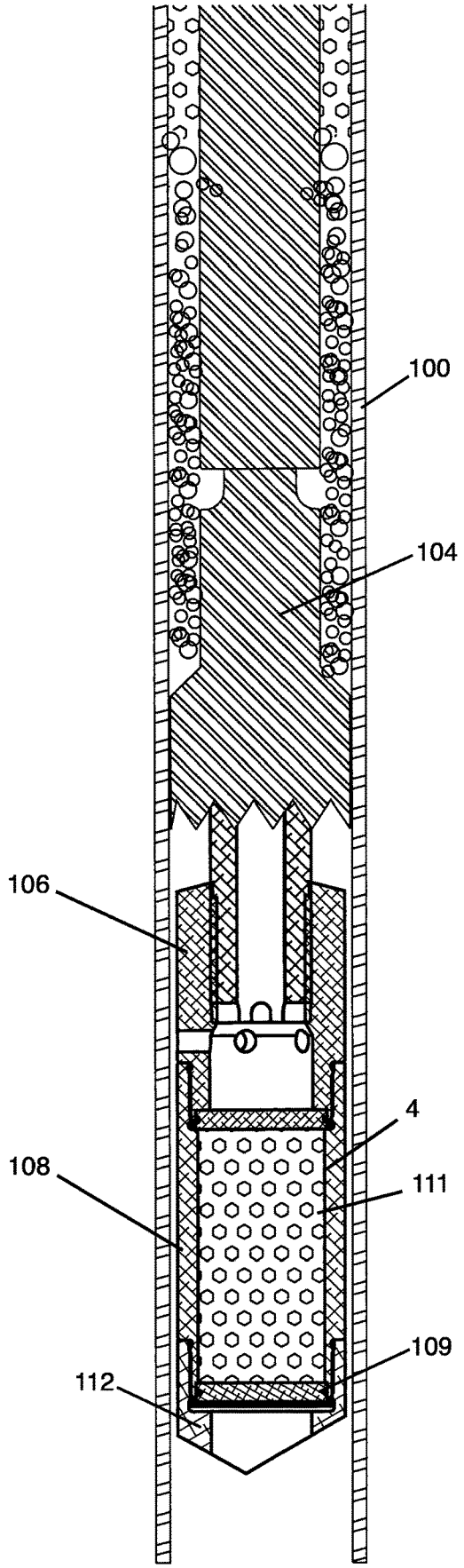
FIG. 34 is a fifth sequential, sectional view of the released chemicals from the first downhole apparatus within the wellbore and the milling of the second downhole apparatus.

As milling operations continue in FIG. 34, milling device 104 may begin milling an upstream end of second frac plug 106 until the second downhole apparatus 108 with cavity 4 begins descending in wellbore 100. When the second downhole apparatus 108 reaches the next, third, or successive downhole tool (e.g., a third frac plug), mule shoe bottom 112 of second downhole apparatus 108 engages an upstream end of the next downhole tool. Second downhole apparatus 108 may then be milled, thereby releasing the chemicals 11 disposed within sealed pack 111 therein.

Figure 35:
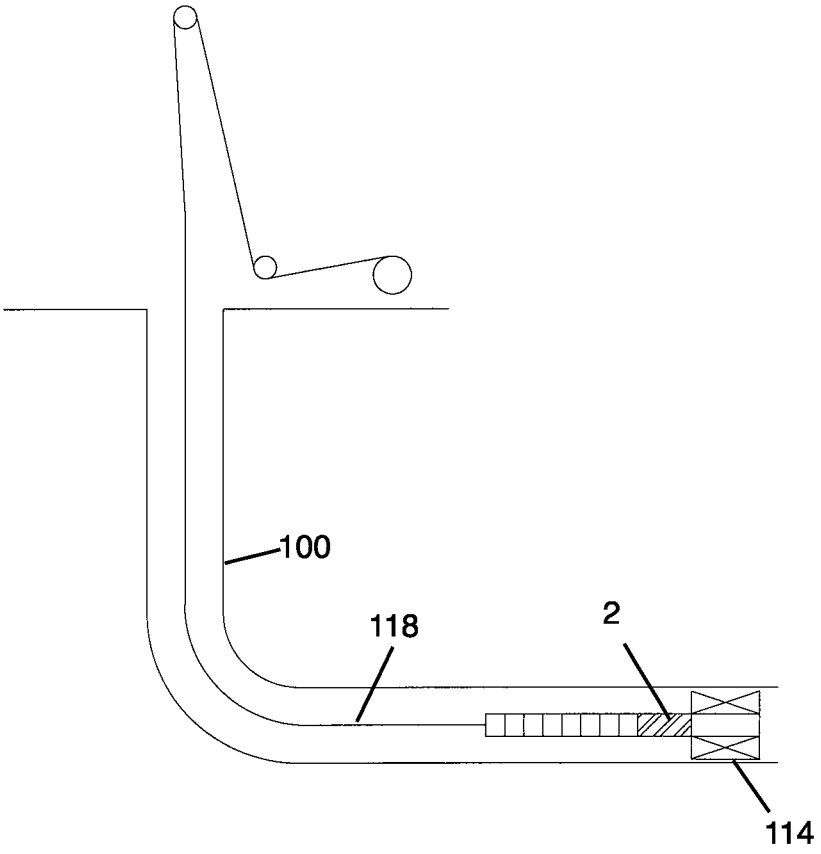
FIG. 35 is a schematic view of an embodiment of the downhole apparatus operatively connected to wireline within the wellbore.
Figure 36:
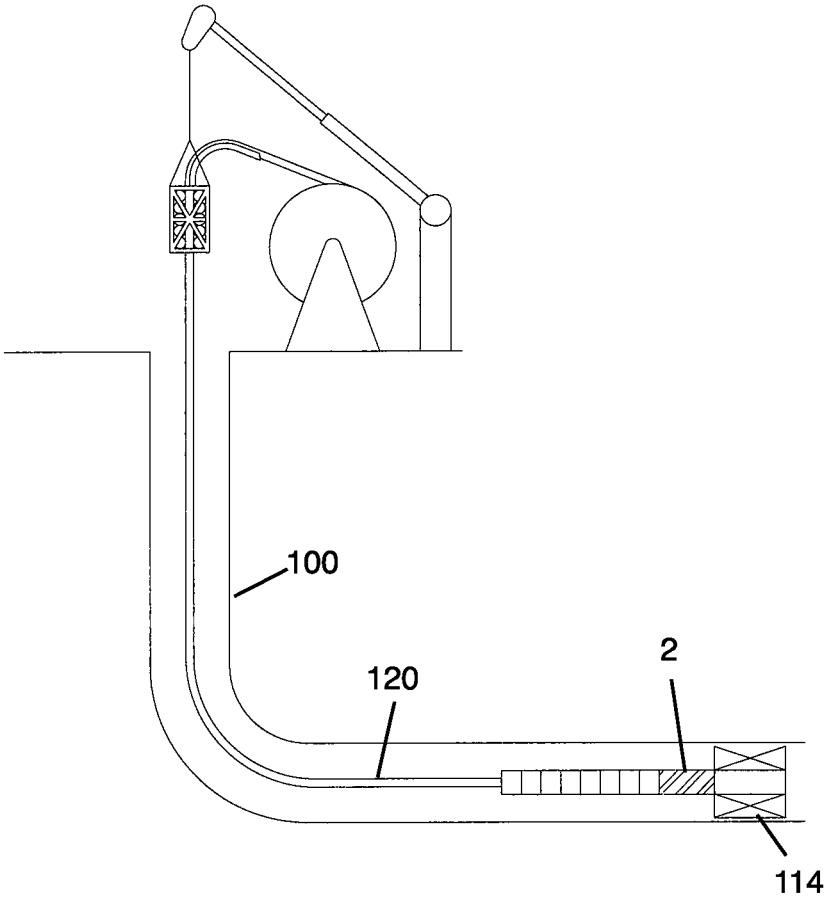
FIG. 36 is a schematic view of an embodiment of the downhole apparatus operatively connected to coiled tubing within the wellbore.
Figure 37:
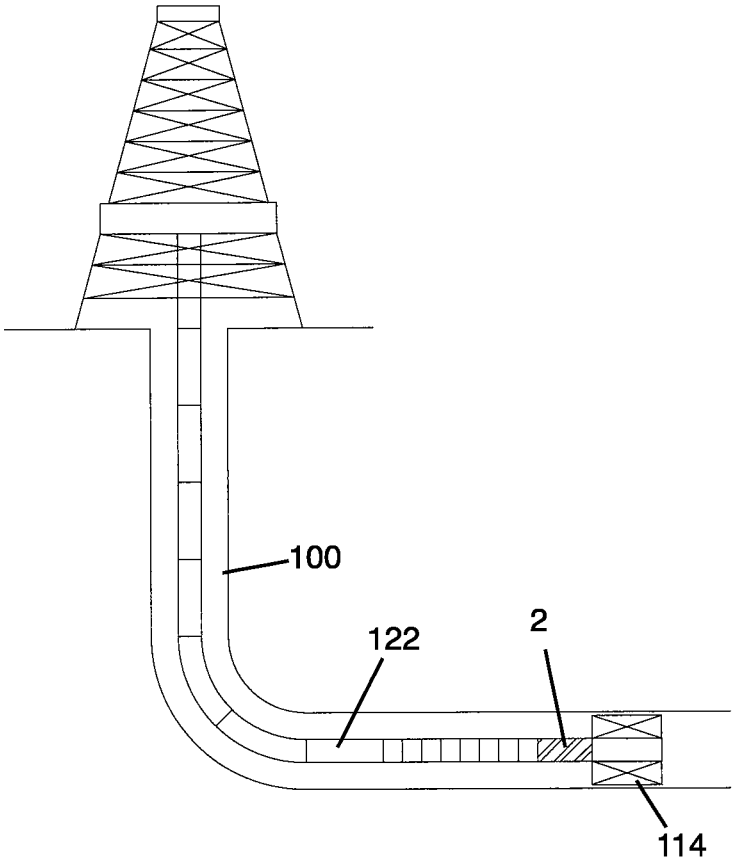
FIG. 37 is a schematic view of an embodiment of the downhole apparatus operatively connected to a drill string within the wellbore.

FIGS. 35-37 illustrate downhole tool 114 (e.g., well-plugging assembly 5) and downhole apparatus 2 disposed within wellbore 100. FIG. 35 illustrates downhole tool 114 and downhole apparatus 2 connected to wireline 118. FIG. 36 illustrates downhole tool 114 and downhole apparatus 2 connected to coiled tubing 120. FIG. 37 illustrates downhole tool 114 and downhole apparatus 2 connected to drill string 122.

As used herein, "upper" and "lower" are to be interpreted broadly to include "proximal" and "distal" such that the structures may not be positioned in a vertical arrangement. Additionally, the elements described as "upper" and "lower" may be reversed such that the structures may be configured in the opposite vertical arrangement.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

What is claimed is:

1. A downhole assembly for a wellbore operation in a wellbore comprising:

a well-plugging assembly including a mandrel with a central bore extending therethrough, the mandrel having an upper end and a lower end;

a shoe nut including a plurality of external axial guides and a plurality of external protrusions, the shoe nut being detachably connected to the lower end of the mandrel of the well-plugging assembly;

a downhole apparatus configured as a container having an open upper end and a closed lower end, the container having an outer surface and an internal surface defining a cavity, an upper portion of the internal surface including internal threads, wherein the container is detachably connected to the shoe nut via connection between the internal threads of the container and the plurality of external protrusion of the shoe nut;

one or more sealed packs disposed within the cavity of the container, wherein each of the one or more sealed packs is configured as a vacuum sealed bag made of a dissolvable or non-dissolvable plastic; and one or more chemicals disposed within each of the one or more sealed packs.

2. The downhole assembly of claim 1, wherein the one or more chemicals are in the form of a solid, a liquid, a powder, or a gel.

3. The downhole assembly of claim 1, wherein the one or more chemicals are selected from the group consisting of a friction reducer, a lubricator, a corrosion inhibitor, a dye, a pH additive, a dry acid, a salt, a biocide, a bio inhibitor, dry hydrogen peroxide, a chelation agent, an emulsifier, a thinner, and a wellbore additive.

4. The downhole assembly of claim 1, wherein the container includes one or more ports extending from the outer surface to the internal surface thereof, wherein the one or more ports provide fluid communication between the wellbore and the cavity of the container.

5. The downhole assembly of claim 1, wherein the container includes one or more compensating pistons positioned within the cavity of the container, the one or more compensating pistons configured to adjust a volume of the cavity in selective response to a condition within the wellbore.

6. The downhole assembly of claim 5, wherein the condition within the wellbore is a wellbore temperature or a wellbore hydrostatic pressure.

7. The downhole assembly of claim 1, wherein the one or more sealed packs comprise at least one sealed pack having one or more flexible sides.

8. The downhole assembly of claim 1, wherein the well-plugging assembly is a bridge plug, a frac plug, or a packer assembly.

9. The downhole assembly of 1, further comprising a spacer operatively positioned between the shoe nut and the upper end of the container.

10. A method of performing a wellbore operation in a wellbore comprising the steps of:

a) running a downhole assembly down the wellbore, the downhole assembly comprising: a well-plugging assembly including a mandrel with a central bore extending therethrough, the mandrel having an upper end and a lower end; a shoe nut including a plurality of external axial guides and a plurality of external protrusions, the shoe nut being detachably connected to the lower end of the mandrel of the well-plugging assembly; a downhole apparatus configured as a container having an open upper end and a closed lower end, the container having an outer surface and an internal surface defining a cavity, an upper portion of the internal surface including internal threads, wherein the container is detachably connected to the shoe nut via connection between the internal threads of the container and the plurality of external protrusion of the shoe nut; one or more sealed packs disposed within the cavity of the container, wherein each of the one or more sealed packs is configured as a vacuum sealed bag made of a dissolvable or non-dissolvable plastic; and one or more chemicals disposed within each of the one or more sealed packs; and b) releasing the one or more chemicals disposed within the one or more sealed packs by milling where each of the one or more sealed packs is configured as the vacuum sealed bag made of the dissolvable plastic or non-dissolvable plastic or by dissolving where each of the one or more sealed packs is configured as the vacuum sealed bag made of the dissolvable plastic.

11. The method of claim 10, wherein the well-plugging assembly is a bridge plug, a frac plug, or a packer assembly.

12. The method of claim 10, wherein the one or more chemicals are in the form of a solid, a liquid, a powder, or a gel.

13. The method of claim 10, wherein the one or more chemicals are selected from the group consisting of well-cleaning agent, a suspending agent, a friction reducer, a lubricator, a corrosion inhibitor, a dye, a pH additive, a dry acid, a salt, a biocide, a bio inhibitor, dry hydrogen peroxide, a chelation agent, an emulsifier, a thinner, and a wellbore additive.

14. The method of claim 10, wherein the container includes one or more ports extending from the outer surface to the internal surface thereof, wherein the one or more ports provide fluid communication between the wellbore and the cavity of the container.

15. The method of claim 10, wherein the container includes one or more compensating pistons positioned within the cavity of the container, wherein the one or more compensating pistons adjust a volume of the cavity in selective response to a condition within the wellbore.

16. The method of claim 15, wherein the condition in the wellbore is a wellbore temperature or a wellbore hydrostatic pressure.

* * * * *